US011280016B2

(12) United States Patent
Palumbo et al.

(10) Patent No.: US 11,280,016 B2
(45) Date of Patent: Mar. 22, 2022

(54) APPARATUS AND METHOD FOR IN-SITU ELECTROSLEEVING AND IN-SITU ELECTROPOLISHING INTERNAL WALLS OF METALLIC CONDUITS

(71) Applicant: INTEGRAN TECHNOLOGIES INC., Mississauga (CA)

(72) Inventors: Gino Palumbo, Toronto (CA); Leo Monaco, Toronto (CA); Jonathan McCrea, Toronto (CA); Klaus Tomantschger, Mississauga (CA); Dave Limoges, Etobicoke (CA); Michael Mills, Toronto (CA)

(73) Assignee: Integran Technologies Inc., Mississauga (CA)

( * ) Notice: Subject to any disclaimer, the term of this patent is extended or adjusted under 35 U.S.C. 154(b) by 152 days.

(21) Appl. No.: 16/824,165

(22) Filed: Mar. 19, 2020

(65) Prior Publication Data

US 2021/0292930 A1 Sep. 23, 2021

(51) Int. Cl.
*C25D 7/04* (2006.01)
*C25F 3/16* (2006.01)
(Continued)

(52) U.S. Cl.
CPC ..... *C25D 7/04* (2013.01); *C25D 3/12* (2013.01); *C25D 3/38* (2013.01); *C25F 3/16* (2013.01); *C25F 7/00* (2013.01)

(58) Field of Classification Search
None
See application file for complete search history.

(56) References Cited

U.S. PATENT DOCUMENTS 2,106,004 A * 1/1938 Inglee ..... C25D 17/00 204/625
2,764,540 A 9/1956 Farin
(Continued)

FOREIGN PATENT DOCUMENTS

CA 2289779 C * 3/2007 ..... C25F 7/00
FR 2693129 1/1994
(Continued)

OTHER PUBLICATIONS

D. Landolt, Review Article, Fundamentals Aspects of Electropolishing, Electrochemica Acta, vol. 32, No. 1, pp. 1-11, 1986.
(Continued)

*Primary Examiner* — Louis J Rufo
(74) *Attorney, Agent, or Firm* — Rankin, Hill & Clark LLP

(57) ABSTRACT

An apparatus and system for in-situ electropolishing and/or for in-situ electroforming a structural or functional reinforcement layer such as a sleeve of a selected metallic material on the internal surfaces of metallic tubular conduits are described. The apparatus and system can be employed on straight tubes, tube joints to different diameter tubes or face plates, tube elbows and other complex shapes encountered in piping systems. The apparatus includes components which can be independently manipulated and assembled on or near a degraded site and, after secured in place, form an electrolytic cell within the workpiece. The apparatus contains counter-electrodes which can be moved relative to the workpiece surface during the electroplating and/or electropolishing operation to provide flexibility in selecting and employing electropolishing process parameters and electroplating process parameters to design and optimize the surface roughness as well as the size, shape and properties of the electrodeposited reinforcing layer(s).

20 Claims, 8 Drawing Sheets

(51) Int. Cl.

| | |
|---|---|
| ***C25F 7/00*** | (2006.01) |
| ***C25D 3/12*** | (2006.01) |
| ***C25D 3/38*** | (2006.01) |

(56) References Cited

U.S. PATENT DOCUMENTS

| | | | |
|---|---|---|---|
| 3,673,073 | A | 6/1972 | Tobey |
| 3,974,042 | A | 8/1976 | Angelini |
| 4,624,750 | A | 11/1986 | Malagola |
| 4,696,723 | A | 9/1987 | Bosquet et al. |
| 4,826,582 | A | 5/1989 | Lavalerie et al. |
| 5,352,266 | A | 10/1994 | Erb |
| 5,433,797 | A | 7/1995 | Erb |
| 5,516,415 | A | 5/1996 | Palumbo |
| 5,527,445 | A | 6/1996 | Palumbo |
| 5,538,615 | A | 7/1996 | Palumbo |
| 5,660,705 | A | 8/1997 | Michaut |
| 5,695,621 | A | 12/1997 | Pop et al. |
| 7,320,832 | B2 | 1/2008 | Palumbo |
| 8,025,979 | B2 | 9/2011 | Palumbo |
| 8,367,217 | B2 | 2/2013 | Gonzalez |
| 9,005,420 | B2 | 4/2015 | Tomantschger |
| 9,249,521 | B2 | 2/2016 | Tomantschger |
| 9,987,699 | B2 | 6/2018 | Taylor |
| 2003/0234181 | A1 | 12/2003 | Palumbo |
| 2005/0205425 | A1 | 9/2005 | Palumbo |
| 2017/0241035 | A1 | 8/2017 | Patel et al. |
| 2019/0128467 | A1 | 5/2019 | Lee et al. |

FOREIGN PATENT DOCUMENTS

| | | | |
|---|---|---|---|
| KR | 950025121 A | * | 9/1995 |
| WO | WO2019151487 | | 8/2019 |

OTHER PUBLICATIONS

I. Brooks, G. Palumbo, F. Gonzalez, A. Robertson, K. Tomantschger & K. Panagiotopoulos, "Structural Repair of Degraded Process Piping by In-Situ Deposition of Nanostructured Materials" AESF SUR/FIN 2003 Proceedings.

G. Palumbo, F. González, K. Tomantschger, U. Erb & K.T. Aust, "Nanotechnology Opportunities for Electroplating Industries" Plating & Surface Finishing • Feb. 2003.

Written Opinion and International Search Report of PCT/CA2021/050349 dated May 31, 2021, 11 pages.

* cited by examiner

APPARATUS AND METHOD FOR IN-SITU ELECTROSLEEVING AND IN-SITU ELECTROPOLISHING INTERNAL WALLS OF METALLIC CONDUITS

This invention was made with government support under contracts N00014-14-C-0199 (2014) and N00014-18-C-1048 (2018) awarded by the Office of Naval Research (ONR). The Government has certain rights in this invention and the invention may be manufactured and used by or for the Government for Government purposes without the payment of any royalties thereon or therefore.

FIELD OF THE INVENTION

This invention is directed to a process and apparatus for in-situ electropolishing and/or in-situ electroplating metallic material layers onto the internal diameter of one or more tubular parts in an electrolytic cell formed in part by the host tubular conduit using direct (D.C.) or pulsed current. At their respective ends, the metallic material layers or sleeves can have smooth, tapered transition zones to the host tubing to which they adhere. This invention relates particularly to a process and apparatus for selectively electroplating a metal patch and/or sleeve onto the interior surface of a damaged or degraded portion of a metallic tube or conduit, however, it can also be employed to coat the interior surface of new metallic tubes, pipes and conduit. In addition, the same apparatus can also be used for selectively electropolishing the host tubular part before or after electrodepositing the metallic sleeve/patch.

BACKGROUND OF THE INVENTION

Metal tubes and pipes are commonly used, e.g., in heat exchangers, condensers and fluid delivery conduits in various applications ranging from transportation applications including, but not limited to, land transport vehicles, ships and other marine vessels, and airplanes, to stationary applications, including, but not limited to, above-ground and underground pipelines for the transport of fluids including liquid petroleum fuel, water, sewer, natural gas, etc. In all applications the metallic tube material can degrade with time and, means are been sought to economically and conveniently repair a damaged section by an in-situ method. Similarly, effective and economic electrolytic processes are continuously being sought for coating the inside of tubes to protect them from wear, erosion and corrosion during use and for polishing exposed surfaces.

A number of electrosleeving methods applied to the inside of degraded pipe sections that involve electroplating have been disclosed in the prior art:

Tobey et al. in U.S. Pat. No. 3,673,073 (1972) discloses an apparatus and a method for depositing a coating onto the inside surface of a hollow substrate. The disclosed apparatus and method are particularly adapted for electroplating the inside diameter of a tube. A travelling compartment, i.e., a "probe" is included which is adapted to traverse the inside of the tube member to be plated. The compartment has an inlet and an outlet port. A source of electroplating solution includes a first conduit coupled between the source to the inlet port and a second conduit coupled between the source and the outlet port. Means are included for circulating the electroplating solution through the travelling compartment via the first conduit and second conduit. An anode disposed within the compartment is coupled to a source of electrical energy. The anode is securely mounted in the compartment and the entire compartment is designed to be moved to the desired location for stationary electroplating or the entire compartment can be moved during the electroplating operation. No information is provided about the design of the head and end seals and how a leak-tight seal is maintained when moving the entire probe along the tube during electroplating. The disclosed apparatus has a predetermined length as the anode is firmly attached to the head and end seals. In addition, the probe requires access to the internal diameter of the tube from both ends (see FIG. 1 of Tobey).

Malagola et al. in U.S. Pat. No. 4,624,750 (1986) describes a process for providing corrosion protection to a steam generator tube before final assembly wherein a metallic layer is deposited on a small section of the inside of the tube. In one embodiment (FIG. 5), a nickel deposit is produced in the transition zone of the tube and on either side of this zone over a sufficient length, either by providing a plug of a sufficient length or by moving the electrode and the plug or "probe" inside the tube in a controlled manner. No information is provided about the design of the end seals and how a leak-tight seal is maintained when moving the probe along the tube of varying diameter during electroplating. The plating cell size/length is fixed, i.e., the anode does not move relative to any other hardware of the plug. As, in the case of the repair of nuclear steam generator tubes, the tubes would be filled with fluid it is unclear how the probe can be moved back and forth in a fluid filled tube unless the entire tube is drained and filled with a compressible gas prior to applying the repair.

Palumbo et al. in each of U.S. Pat. No. 5,527,445 (1996), U.S. Pat. No. 5,516,415 (1996) and in U.S. Pat. No. 5,538,615 (1996) discloses a plating process for the repair of nuclear steam generator tubes by in-situ electroforming a metallic structural layer on the inside of the degraded metal tube section. The electrosleeve is applied by a convenient remote process forming a structural layer on the inside of the affected tube section. The inner diameter of the tube to be repaired is at least 5 mm, but typically between 1 cm and 5 cm. The thickness of the electroformed layer is typically 0.1 to 2 mm and its length ranges from 10 cm to 90 cm. The plating cell or "probe" is moved to the desired tube location to be repaired and then deployed. The plating cell/probe is specifically designed to be inserted into an opening in the tube such as a flange and is guided to the location within the tube to be repaired. Once the probe is in place of the damaged section of the tube to be repaired the probe is secured to the host tubing by inflating the end seals. During the refurbishment/repair operation all parts of the probe remain in place and remain stationary. No individual or independent guide wires for the "plugs", namely the "head" and "end" sealing piece, are used, i.e., the length/size of the probe is fixed. The head and end-piece of the probe are connected through several means, including the plastic housing, the capillary air-line and the anode resulting in the distance between the head and end-piece being fixed and therefore the size of the plating cell and the length of the sleeve plated are fixed as well. Furthermore, due to the design of the probe, the thickness of the deposited sleeve is dictated by the electrolyte, current density and plating time used and the thickness of the sleeve cannot be regulated along the length of the sleeve. Similarly, multiple sleeves cannot be applied without deflating the probe and moving the probe in its entirety to another location, followed by reflation, etc.

Michaut et al. in U.S. Pat. No. 5,660,705 (1997) describes a thick, non-magnetic Ni—B metal sleeve applied on the inside of a tube to repair a steam generator tube crimped in a tube plate. The inside diameter of the tube to be repaired is 2 cm and the coating thickness ranges from 0.5 to 1.5 mm. The plating cell is moved inside the tube to the tube location to be repaired, however, like in the Palumbo electrosleeving process described above, the plating cell remains in place during the electroplating operation and has no moving parts. As illustrated in FIGS. 4 and 5 of Michaut the resulting thick sleeves have sharp edges at both respective ends resulting in challenging flow conditions in service.

Similarly, a number of electromachining and electropolishing methods have been disclosed aimed at reducing the surface roughness of a metallic material:

Farin et al. in U.S. Pat. No. 2,764,540 (1956) describes a method of electropolishing the inside of an elongated tubular body which consists of circulating an electrolytic solution under pressure through the tubular body while applying a voltage between the tubular body and a centered, movable cathode. The disclosed cathode has a predetermined length extending into the vertically positioned tube from the top and does not contain seals to isolate the area to be polished from the remaining tube. In fact, the electrolyte is circulated through the entire tube which requires access to the internal diameter of the tube from both ends and the top is vented so the gases generated during the electropolishing process can escape.

Taylor et al. in U.S. Pat. No. 9,987,699 (2018) describes a method and system for electrochemically machining a hollow body of a metal or a metal alloy having a variable internal diameter. The hollow body is oriented vertically, with the electrode oriented vertically therein and a cathode is provided along the entire length of the hollow body. The hollow body is at least partially filled with an aqueous, acidic electrolyte solution of low viscosity. An electric current is passed between the hollow body and the electrode, where the electric current includes a plurality of anodic pulses and a plurality of cathodic pulses, and where the cathodic pulses are interposed between at least some of the anodic pulses. The disclosed cathode has a predetermined length extending along the entire length of the vertically positioned tube and does not contain any means to electropolish only part of the tube's surface. The electrolyte is circulated through the entire tube which requires access to the internal diameter of the tube from both ends and the top is vented so the gases generated during the electropolishing process can escape.

SUMMARY OF THE INVENTION

As discussed above, the various "electrosleeving processes" disclosed in the prior art and applied, e.g., to inside tube surfaces of nuclear steam generator tubes, have limitations. Namely the thickness of the coating is limited to typically less than 1 or 5 mm due to considerations such as probe removal, flow restriction, coating surface finish and the need for maintaining a non-destructive inspection capability such as eddy current or ultrasound testing. Thin coatings inside the tube are frequently insufficient to reestablish the original mechanical properties, if this is a desired objective. Alternatively, the objective may be to provide a functional repair meaning improving or reestablishing erosion and/or corrosion resistance. Relying on a substantial grain-refinement to enable a complete structural repair compromises other physical properties such as ductility. The method of handling and sealing the probe against the inside tube wall can, at times, be challenging. Moving the entire probe back and forth during the plating operation results in increased wear and deterioration of the polymer seals as well as the incorporation of seal debris in the metallic coating. This frequently causes leakage of the corrosive electrolyte out of the "sealed compartment" causing further degradation. Leakage of the heat-transfer medium into the probe contaminates the electrolyte solution and/or the various process and washing fluids used in the process. In addition, none of the prior art teachings deals with the rough surface finish obtained with thicker electrodeposited coatings (≥0.1 mm), the quality of the fluid-tight seal, and how the tightness of the seals is affected when a probe filled with electrolyte is moved along the tube inside surface while the internal diameter of the tube constantly changes while a metallic layer is being deposited.

Probe insertion/removal may be difficult due to the location of the damaged area and the geometry of the tubing, e.g., in long and more complex piping systems involving elbows, tees, piping of various inner diameter, etc. The application of a suitable sleeve in regions other than straight areas, such as bends, elbows, tees and the like can be difficult as well. Inside diameter electrodeposition repairs usually provide a sleeve of essentially uniform thickness along its length which may not be desired and/or required. For instance, in the case of larger inner diameter tubes with highly localized damaged areas, a "patch" may be a more suited repair technique as compared to sleeving the entire tube section, thereby minimizing build-up of additional material and minimizing heat exchange property changes. Therefore the need exists for a repair technique that can be used in applications not currently satisfied by inside inner diameter electrodeposition methods noted above.

Due to the design of prior art electrosleeving probes their use for electropolishing has heretofore not been feasible. Electropolishing typically requires much higher current densities and solution flow rates than used in electroplating and the massive amounts of gas generated by the electropolishing process cannot be managed by these devices.

It is therefore an objective of the invention to coat the inside surface of new tubes and pipes as well as to repair corroded, eroded, cracked or otherwise degraded sections of the inside surfaces of hollow metallic workpieces including, e.g., at least a section of a tube, optionally with more complex geometries such as elbows, tees, flanges and connections to, e.g., base plates and the like by applying a suitable metallic coating to the inner surface of the damaged section using electrodeposition.

It is an objective of the invention to coat at least part of the inside surface of tubes, pipes and the like, including, but not limited to, heat exchangers, condensers and fluid delivery conduits which are at least 1 foot, preferably at least 5 feet, preferably at least 10 feet and more preferably at least 20 feet long.

It is another objective of the invention to provide a "sleeving apparatus" or "probe" which can be inserted into the inside surface of tubes and pipes from one end only, i.e., only one access point is required for the insertion, deployment and the operation of the probe(s).

It is an objective of the invention to coat at least part of the inside surface of tubes, pipes and the like, which have an internal diameter of at least 4 mm, preferably at least 10 mm and more preferably at least 20 mm and up to at least 10 cm, preferably up to at least 20 cm and more preferably up to at least 30 cm.

It is another objective of the invention to provide a repair that does not require draining the entire fluid from the tube to be repaired or the entire multi-tube arrangement by providing a probe that, during the positioning operation has a smaller diameter than the smallest internal diameter of the tube or any obstruction between the point of entry and the point of use to allow the fluid to flow past the probe during the insertion. Once the location to be repaired and/or processed is reached, the probe's inflatable ends (head and end-piece) inflate and seal off the area subject to the repair, forming an electrolytic cell. Any remaining fluid trapped in the electrolytic cell can be removed and activation, washing and plating fluids can be provided from an external reservoir without contaminating the original fluid present in the tube, or tube system. More complex workpieces such as tees may require more than one end-piece to create a fluid-tight plating cell.

It is another objective of the invention to deposit at least one metallic patch or sleeve on the inside surface of tubes and pipes using an apparatus which is inserted into the tubes and, once positioned appropriately, hermetically seals off at least part of the length of the tubes to isolate the "workpiece area" to be electroplated. This creates a "workspace length", hereafter termed $l_{Compartment}$, defining the maximum length of the tube to be sleeved after securing the end and head-pieces in place and ranging from the end-piece to the head-piece(s).

It is another objective of the invention to provide a probe for a workpiece length, $l_{Compartment}$, ranging from as little as 4 inches, preferably 8 inches and more preferably 12 inches to as much as 2 feet, preferably 6 feet, and more preferably 12 feet and up to 25 feet.

It is another objective of the invention to deposit a metallic patch or sleeve on the inside surface of tubes and pipes using an apparatus which comprises one or more counter-electrodes (anodes) which can be moved relative to the fluid-tight seals of the apparatus to electrodeposit one or more metallic patches or sleeves. The "counter-electrode/anode assembly length" is always shorter than the "workspace length" to enable the movement of the counter-electrode assembly along the workspace length. Due to the movement of the counter-electrode relative to the seals and the host tube, the resulting sleeves are naturally tapered at the start of the sleeve as well as the end of the sleeve. The length and degree of taper can be controlled by the applied current density and the speed at which the counter-electrode is moved relative to the seals/tube.

It is another objective of the invention to provide a "counter-electrode/anode assembly length" ranging from as little as 1 inch, preferably 4 inches and more preferably 8 inches to as much as 1 foot, preferably 2 feet, and more preferably 8 feet, while always being shorter than the "workspace length" of the tube to allow for the movement of the counter-electrode assembly relative to the workpiece.

It is another objective of the invention to provide one or more counter-electrode assemblies which contain active electrode segments which are rigid or flexible and comprise means for automatically centering the counter-electrode segments within the inner diameter of the tube. The counter-electrode(s) can be sectioned, i.e., multiple relatively short (compared to the workpiece length) anode sections/segments are connected via flexible sections in a chain like manner to enable the counter-electrode assembly to be maneuvered around bends and turns in the tube to (i) enable moving of all components of the apparatus to the desired area to be plated though bends and turns and not be limited to be inserted in straight tubes only and (ii) enable the sleeving of tube sections which are not straight such as a bend, elbow, tee etc.

It is another objective of the invention to provide one or more counter-electrode assemblies which contain active counter-electrode segments comprising electrically non-conductive shields or other restrictions to enable the formation of distinct metallic patches rather than homogeneous sleeves by selectively blocking off part of the circumferential throwing power of the tubular electrode segments.

It is another objective of the invention to provide active counter-electrodes segments which, during the electroplating process, are soluble anodes (hereinafter "SAs"), i.e., part of the anode gets anodically dissolved during the electroplating process releasing metal ions into the electrolyte solution and cathodically plating these metal-ions onto the tube surface.

It is another objective of the invention to provide active counter-electrode segments which are insoluble, i.e., dimensionally stable electrodes (hereinafter "DSEs") which are not consumed during the electroplating or electropolishing process and typically, at least in part, decompose the electrolyte, e.g., in the case of an aqueous electrolyte generate oxygen or hydrogen gas. One or more SAs can be used along one or more DSEs as well.

It is a further objective of this invention to provide a process for plating a fine-grained metal, metal alloy or metal matrix composite on the internal surface of a tube section to provide a full functional and/or structural repair.

It is a further objective of this invention to provide a coating which is uniform throughout its thickness and length or is non-uniform, e.g., graded in one or more directions and/or laminated, including, but not limited to, nano-laminates, i.e., layered coatings where distinct (according to grain size, composition, etc.) sub-layers are less than 1 μm, preferably less than 100 nm thick.

It is a further objective of this invention to provide a metallic sleeve having an outer/exposed surface which is preferably smooth ($R_a$<1 μm), e.g., by applying an electropolishing step, specifically by macro-smoothing to eliminate surface features >1 μm, followed by micro-smoothing to achieve a surface roughness <1 μm up to a mirror finish.

It is therefore an objective of the invention to electropolish the inside surface of tubes before and/or after the electroplating process to a surface roughness of $R_a$<1 μm, preferably $R_a$<0.5 μm and more preferably $R_a$<0.1 μm.

It is another objective of the invention to provide a metallic sleeve on the inside surface of tubes, pipes and the like, which has a varying thickness along the length, e.g., building up thicker cross-sections in areas where the host tube has deteriorated significantly while reducing the deposit thickness in areas of the tube where the deterioration of the host tubing is limited, i.e., by adjusting the current applied to the anode(s) and the relative speed of movement of the anode(s) along the workpiece and/or by using segmented anodes and current shields, the operator has almost unlimited control over the thickness profile without having to reposition the plating cell within the workpiece.

It is a further objective of this invention to provide an apparatus for the selectively in-situ electrodeposition of a structural reinforcing layer of selected metallic material on an internal surface of a degraded section of a metallic workpiece, especially a pipe, to reestablish its mechanical properties.

It is an objective of the invention to provide a reinforcing layer thickness of at least 0.05 mm, preferably at least 0.1 mm and more preferably at least 0.2 mm and up to at least 1 mm, preferably at least 5 mm and more preferably at least 1 cm.

It is a further objective of this invention to repair or coat at least part of a metallic workpiece, such as tubes, pipes and the like, made of Al, Co, Cu, Fe and Ni bearing alloys by depositing patches/sleeved also comprising Al, Co, Cu, Fe and Ni bearing alloys. For instance, in the case of host tubes made of a Ni—Cu alloy preferably the electrodeposited patch/sleeve is a Ni—Cu alloy as well, although not necessarily of identical composition.

It is a further objective of this invention to deposit a thick, corrosion resistant coating of a metallic material having a microstructure which is one of or a combination of a crystalline microstructure (i.e., coarse-grained with an average grain size ≥1,000 microns, fine-grained with an average grain size <1,000 microns), and an amorphous microstructure.

The process is particularly suited for refurbishing degraded portions of tubes by electroplating a metallic patch or sleeve on the inside of the degraded portion of the tube without having to remove the tube from the apparatus or installation in which the tube is used. In other words the process provides an in-situ repair of the tubular conduit. The electrolytic cell formed in the process can also be used for electropolishing the tube surface before or after electrodepositing one or more patches/sleeves by merely replacing the "electroplating electrolyte" by a suitable "electropolishing electrolyte" and changing the applied current from a cathodic current to an anodic current versus the workpiece. The invention may also be applied to a new workpiece such as a tube before it is connected to an apparatus or installation.

These and other objectives are met by the below described process and apparatus for in-situ electropolishing and/or in-situ electrodepositing a structural reinforcing layer of a selected metallic material onto an internal surface of a metallic workpiece such as a pipe. When a degraded section on a pipe or tube is repaired in accordance with this invention, the inside wall of the pipe is preferably restored to its original mechanical design specifications, including burst pressure, bend strength, surface finish, fatigue and corrosion performance. The process is carried out by creating an electrolytic cell around the degraded portion of the pipe, preferably without removing the pipe from the environment or installation in which it is utilized. The electrolytic cell is defined by the tube(s), a head-piece and one or more end-pieces. Once positioned in place the seals on the end and head-piece(s) are activated, providing a fluid-tight and leak-tight volume, defining the "electrolytic cell". At least one counter-electrode assembly is provided within the electrolytic cell. The counter-electrode is located within the probe and can freely move along the degraded portion of the tube within the electrolytic cell. More than one counter-electrode may be utilized. Preferably the counter-electrode or counter-electrodes face at least part of the degraded portion of the tube and extend lengthwise along at least part of degraded portion of the pipe so that the electroplated metallic layer formed by the electrodeposition process forms a patch/sleeve which extends beyond the degraded portion of the pipe. The apparatus/probe also includes appropriate electrical wiring and electrical connections for connection to one or more sources of electric current required for the electroplating procedure. An electrical connection is made to the pipe undergoing repair so that the tube functions as the workpiece. Thus the electrolytic cell includes one working-electrode and at least one counter-electrode with electrical connections to a source of electric current, such as a power supply. The end-piece of the electrolytic cell further includes a fluid supply inlet and a fluid supply outlet so that the electrolyte or plating solution which contains ions of the metal to be electroplated, can be circulated by means of a pump throughout the electrolytic cell. The fluid pump can be used to adjust the fluid flow volume and the flow velocity through the electrolytic cell. In addition, the electrolyte or plating solution is maintained at the desired electroplating temperature (e.g., between 0° C. to 100° C.) by cooling or heating. For example the fluid supply inlet and outlet may be connected to a temperature controlled reservoir for the regulation of the temperature of the plating solution or any other fluid which is circulated through the plating cell. The supply inlet and outlet may also be connected to a source of other fluids used in the process. For example, the inlets and outlets may be connected to a source of cleaning fluid such as a surface cleaning fluid, activation fluid, striking fluid and electrochemical polishing fluid. For example, a cleaning fluid may be first circulated through the plating cell to clean the exterior of the pipe prior to the circulation of the plating solution.

Similarly, the electrolyte used in the electropolishing process is also circulated through the electrolytic cell and an external reservoir via the same fluid lines. The external reservoir is used to adjust the solution temperature (e.g., between 0° C. to 120° C.), the solution composition and separates and releases gases generated during the electrolytic process from the electrolyte solution.

According to one aspect of the invention, an electrolytic process method for selectively electropolishing at least a portion of an internal surface of a tubular workpiece in-situ and/or selectively electrodepositing at least one metallic layer or patch on at least a portion of the internal surface of a tubular workpiece in-situ by forming an electrolytic cell comprises:

(i) inserting a probe comprising a non-conductive end-piece, at least one non-conductive head-piece and at least one counter-electrode assembly and their ancillary components into the tubular workpiece;

(ii) moving and positioning the at least one head-piece by at least one first independent guide wire to a predetermined first location within the tubular workpiece; followed by:

(iii) moving and placing the at least one counter-electrode assembly by at least one electrode guide conduit to a predetermined second location within the tubular workpiece; followed by:

(iv) moving and positioning the end-piece by a second independent guide wire to a predetermined third location within the tubular workpiece;

(v) establishing fluid-tight seals between the tubular workpiece and each of the end-piece and the at least one head-piece thereby securing the end-piece and the at least one head-piece at their respective predetermined locations, thereby forming a fluid-tight electrolytic cell defined by an internal volume created and confined by the tubular workpiece, the at least one head-piece and the end-piece, wherein the second location of the at least one counter-electrode assembly is also within the electrolytic cell;

(vi) wherein the end-piece further provides a fluid-tight feed through of the at least one first guide wire and the at least one electrode guide conduit;

(vii) providing electrical connections to both the workpiece and, via said at least one counter-electrode conduit to the at least one counter-electrode assembly;

(viii) passing electrical current provided by an associated power supply between said workpiece and said at least one counter-electrode assembly while circulating electrolyte throughout the electrolytic cell while, at least at times, moving the at least one counter-electrode assembly relative to the workpiece during the electrolytic process to initiate the in-situ selective electropolishing and/or selective electrodepositing process; and (ix) collecting the electrolyte solution exiting the electrolytic cell and prior to recirculating the electrolyte solution back to the electrolytic cell in an associated external reservoir performing at least one monitoring/adjustment task selected from the group consisting of, electrolyte composition, pH, temperature, solid impurity filtering, and gas separation.

According to another aspect of the invention, an apparatus for in-situ selectively electropolishing and/or selectively electrodepositing a metallic coating on a portion of an internal surface of a tubular workpiece comprises:

(i) an enclosed electrolytic cell defined by part of the internal surface of the tubular workpiece which represents a working-electrode, and at least one non-conductive head-piece and a non-conductive end-piece, each of the at least one head-piece and the end-piece forms a fluid-tight seal against the internal surface of the tubular workpiece;

(ii) independent guide wires for positioning the at least one head-piece and the end-piece at respective first and second predetermined locations within the tubular workpiece;

(iii) the end-piece further includes fluid-tight feed throughs for the at least one guide wire of the at least one head-piece and at least one electrically non-conductive counter-electrode guide conduit; and (iv) at least one counter-electrode assembly positioned within electrolytic cell, the at least one counter-electrode assembly having at least one active electrode segment centered within an inner diameter of the workpiece by at least one spacer and connected to the at least one counter-electrode guide conduit, the at least one counter-electrode assembly configured to supply electrical current from an associated power supply to the workpiece and the at least one active electrode segment, wherein the at least one counter-electrode assembly is configured to move relative to the workpiece, the end-piece and the at least one head-piece during the electropolishing and/or electroplating operation.

Substrate Specification:

In one embodiment the base article/substrate the coating is applied to is a metallic material. Typical metals and alloys used comprise at least one element selected from the group consisting of Al, Co, Cr, Cu, Fe, Mg, Mn, Ni, Sn, Ti, W, Zn, and Zr, with alloying additions consisting of B, P, C, Mo, S, and W, and particulate additions consisting of carbides, oxides, nitrides and carbon (carbon black, carbon nanotubes, diamond, graphite, graphite fibers, and graphene). The present invention is particularly suitable for the repair of degraded metallic workpieces containing at least part of a tube, which are made of Fe, Cu and Ni based alloys.

Coating Specification:

The electroformed coating patch/sleeve may be at least one metal selected from the group consisting of Ag, Al, Au, Cu, Co, Cr, Ni, Fe, Pb, Pd, Pt, Rh, Ru, Sn, Mo, Mn, W, V and Zn. In addition, the electroformed coating layer may be an alloy containing at least one element from the list above. In additions, metallic materials may further comprise alloying elements selected from the group consisting of B, C, P, S and Si.

The metal and metal alloys which are deposited may further comprise particulate additives, referred to herein as metal matrix composites (MMCs), to improve the physical characteristics of the metal. The particulate additives are incorporated into the metal or metal alloy during the electroplating procedure by, for example, suspending the particles in the plating solution so that the particles become entrapped in the electrodeposited metal or metal alloy. Suitable particulate additives include metal powders, metal alloy powders, metal oxide powders, nitrides, carbon (carbon black, carbon nanotubes, diamond, graphite, graphite fibers, and graphene), carbides, $MoS_2$, and organic materials such as polyolefins and polytetrafluoroethylene (PTFE). Suitable metal oxides include oxides of Al, Co, Cu, In, Mg, Ni, Si, Sn, V, and Zn. Suitable nitrides are nitrides of Al, B, C and Si. Suitable carbides include carbides of B, Cr, Bi, Si and W.

The metallic deposit formed in accordance with this invention preferably covers the degraded portion of the pipe to thereby form a patch, e.g., in the form of a sleeve. The patches or sleeves may have a non-uniform thickness in order to enable thicker layers on severely damaged sections or sections particularly prone to erosion or corrosion such as those created by flow induced corrosion in elbows. The non-uniform thickness of the patch or sleeve may be accomplished by the appropriate selection and placement of consumable or inert anodes and the use of shields in the counter-electrode assembly.

It is also possible in the practice of this invention to electrodeposit age-hardenable metallic coatings to form the patch. The strength and thermal stability of such a patch may be increased by a subsequent heat-treatment according to known procedures.

Definitions:

The term "substrate" and "workpiece" as used herein mean a structural product that can be used as a base for an article.

As used herein, the terms "metal", "alloy" and "metallic material" means crystalline and/or amorphous structures where atoms are chemically bonded to each other and in which mobile valence electrons are shared among atoms. Metals and alloys are electric conductors; they are malleable and lustrous materials and typically form positive ions. Metallic materials include Ni—P, Co—P, Fe—P.

As used herein, the terms "metal-coated article", "laminated article" and "metal-clad article" mean an item which contains at least one permanent substrate material and at least one metallic layer or patch covering at least part of the surface of the substrate material. In addition, one or more intermediate structures, such as metalizing layers can be employed between the metallic layer and the substrate material.

As used herein, the term "coating" means a deposit layer applied to part or all of an inner or interior surface of a substrate.

As used herein, the term "metallic coating" or "metallic layer" means a metallic deposit/layer applied to part of or the entire exposed surface of an article and adhering to the surface of the article.

As used herein, the term "metal matrix composite" (MMC) is defined as particulate matter embedded in a metal matrix. MMCs can be produced, e.g., by suspending particles in a suitable plating bath and incorporating particulate matter into the deposit by inclusion.

As used herein the term "laminate" or "nano-laminate" means a metallic coating that includes a plurality of adjacent metallic sub-layers, each of which has an individual layer thickness between 1.5 nm and 1 μm. A "layer" means a single thickness of a substance where the substance may be defined by a distinct composition, microstructure, crystal phase, grain size, and any other physical or chemical property. It should be appreciated that the interface between adjacent layers may not be necessarily discrete but may be blended, i.e., the adjacent layers may gradually transition from one of the adjacent layers to the other of the adjacent layers.

As used herein, the term "coating thickness" or "layer thickness" refers to the depth in the deposition direction and typical thicknesses exceed 25 μm, preferably 150 μm and up to 1 mm.

As used herein, the term "electroplating" or "electrodeposition" refers to an electrolytic metal deposition process in which metal ions from the electrolyte solution are cathodically reduced and deposited on the surface of a workpiece by the passage of electric current.

As used herein, the term "electromachining" or "electropolishing" refers to an electrolytic metal dissolution process in which metals on the surface of a workpiece are anodically oxidized and released as metal ions into the electrolyte solution by the passage of electric current. In this context electropolishing also includes electrochemical polishing, anodic polishing, anodic brightening, anodic levelling, anodic smoothing or electrolytic polishing. Electropolishing is an electrochemical process used for surface finishing based on local differences in dissolution rates between peaks and recesses on a rough surface that preferentially removes material from a metallic workpiece thereby reducing the surface roughness by levelling micro-peaks and valleys, improving the surface finish. It is used to polish, passivate, and deburr metal parts. Electropolishing is often described as the reverse of electroplating and is an alternative to the use of abrasive polishing/finishing operations and is used to polish, passivate, and deburr metal parts.

As used herein, the term "surface" refers to all accessible surface area of an object accessible to the atmosphere and/or a fluid.

As used herein, the term "exposed surface area" refers to the summation of all the areas of an article accessible to a fluid.

As used herein, the terms "exposed inner surface" and "inner surface" refer to all accessible surface area inside of a hollow, e.g. a tubular object. The "exposed inner surface area", in the case of a tube, refers to the summation of all the inside areas of the tube accessible to a liquid.

As used herein, the terms "surface roughness", "surface texture" and "surface topography" mean a regular and/or an irregular surface topography containing surface structures. These surface irregularities/surface structures combine to form the "surface texture".

As used herein the term "smooth surface" means a surface having a surface roughness ($R_a$) less than or equal to 1 μm.

As used herein, the term "electrolytic cell" means an apparatus comprising two electrodes, namely a working electrode and a counter electrode submersed in a common electrolyte. The electrolytic cell can be used as an electroplating cell or as an electropolishing cell.

In the case of a "plating apparatus", "plating cell", "electroplating cell" the inside surface of a tubular object serves as the workpiece (cathode) and at least one counter-electrode (anode) is provided, separated by an ionically conductive electrolyte and means for providing electrical power to at least one workpiece and at least one anode. The "active cell cavity" within the plating cell is created at least in part by the tubular object itself, i.e., the tubular object serves as both (i) the workpiece receiving the coating and (ii) the plating cell wall confining the plating solution. The plating apparatus further includes means for providing fluid circulation through the plating cell to facilitate the insertion and removal of liquids and gases from the plating apparatus cavity and a transport mechanism for placing the at least one anode assembly within the plating apparatus and for moving the at least one counter-electrode assembly at a predetermined speed relative to the workpiece and the end and head seals within the active cell cavity during the electroplating process. After sealing off the tubular object to define the electrolytic cell, the fluid connections are used to draw any fluid from the plating cell, as well as to deliver and withdraw various solutions used during the process including, but not limited to, solutions used for activating the workpiece surface, rinsing solutions, e.g., water for removing any residual solutions in between process steps, striking and other electroplating solution required to deposit a metallic layer onto the workpiece.

Alternatively, the same electrolytic cell can be used to electropolish the electrodeposited metallic layer and/or tube surface, by passing an electrical current between the workpiece (anode) and a counter-electrode (cathode) while circulating a suitable electropolishing electrolyte solution through the electrolytic cell.

As used herein, the term "selective plating" means an electroplating process whereby not the entire surface of the workpiece is coated or whereby not the entire surface of the workpiece is coated at once. In this context, the term selective plating is defined as a method of selectively electroplating localized areas of a workpiece without submersing the entire article into a plating tank. Selective plating techniques are particularly suited for repairing or refurbishing articles, as they do not require the disassembly of the system containing the workpiece to be plated.

As used herein, the term "flexible electrode/anode" means a counter electrode that bends to conform to the shape of the host tube and thereby enables insertion into and removal from tubes which are not straight, e.g., have bends or tees, and also enable plating areas of the tubes which are not straight. Flexible counter-electrodes are designed to largely conform to the shape and size of the host tubing they are used in and furthermore contain a guide, included but not limited to, spacers, bristles etc., which ensure that the counter-electrode is roughly centered at all times within the tubular workpiece to ensure, e.g., a uniform coating thickness throughout the circumference of the workpiece.

As used herein, the term "sectioned electrode" or "segmented electrode" means a counter-electrode that comprises rigid sections joined by flexible sections to form a counter-electrode which is able to conform to the shape of the host tube, similar to pieces of pearls held together by a string to form a necklace.

As used herein, the term "anode" and "cathode" mean the respective electrodes in an electrolytic cell submersed in the common electrolyte and subject to an electrical potential.

As used herein, the term "anode" means an electrochemical electrode which is the positive electrode subject to an oxidation reaction.

As used herein, the term "cathode" means an electrochemical electrode which is the negative electrode subject to a reduction reaction. The workpiece becomes the cathode and the counter-electrode the anode during the electrodeposition reaction. The workpiece becomes the anode and the counter-electrode the cathode during the electropolishing reaction. When reverse pulses are used during the electropolishing or electroplating process the workpiece (and the counter-electrode) alternate between being the anode and the cathode.

As used herein, the term "soluble anode" or "consumable anode" (SA) means a positive electrode that is intended for use in an electroplating cell in which at least one solid metal is oxidized to form a metal-ion that is released into and dissolves in the electrolyte when an electric current passes through the cell it is employed in.

As used herein, the term "non-soluble electrode", "non-consumable electrode" and "dimensionally-stable electrode" (DSE) means a counter-electrode for use in an electrolytic cell which provides sites for the anodic reaction of species present in the electrolyte without being dissolved or consumed itself (apart from unavoidable corrosion). Examples of DSEs include noble metal or carbon/graphite based electrodes and typical anodic reactions using DSEs encountered in aqueous electrolytes include oxygen evolution, in presence of chloride ions in the electrolyte, chlorine evolution, and/or oxidation of other ions present in the electrolyte. Cathodic reactions using DSEs encountered in aqueous electrolytes include hydrogen evolution, and/or reduction of other ions present in solution.

As used herein, the term "dimensionally-stable soluble anode" or "dimensionally-stable consumable anode" means a positive electrode for use in an electroplating cell where the consumable anode material is not provided in loose form but in a coherent way such as on a permanent inert substrate to minimize or altogether avoid the release of particulates from the anode structure upon increased use. Dimensionally-stable consumable anodes preferably do not disintegrate with extended active anode material(s) consumption.

As used herein, the term "soluble/consumable active anode material" means the metallic material(s) oxidized on the positive electrode to form ions which dissolve in the electrolyte and cathodically deposit on the workpiece. The soluble/consumable active anode material can be a layer on an inert/permanent substrate to provide for a soluble/consumable anode which, while being dissolved during anodic oxidation, retains its structural integrity, i.e., the disintegration of the soluble/consumable anode is avoided.

As used herein, the term "electrode interface area" or "interfacial area" means the geometric area created between the cathode and the anode where electrochemical reactions and mass transport take place and which is used to, e.g., determine the applied current density expressed in $mA/cm^2$ or the electrolyte circulation speed through the active anode expressed in L/min and $cm^2$.

As used herein, the term "bath management" means monitoring and taking corrective action of the electrolyte "bath" being employed in an electroplating operation, including, but not limited to: concentration of metal ion(s), additives, byproducts; pH; temperature; impurities; and particulates.

BRIEF DESCRIPTION OF THE DRAWINGS

In order to better illustrate the invention by way of examples, descriptions are provided for suitable embodiments of the method/process/apparatus according to the invention in which.

DETAILED DESCRIPTION OF THE INVENTION AND THE PREFERRED EMBODIMENTS

Figure 1A:
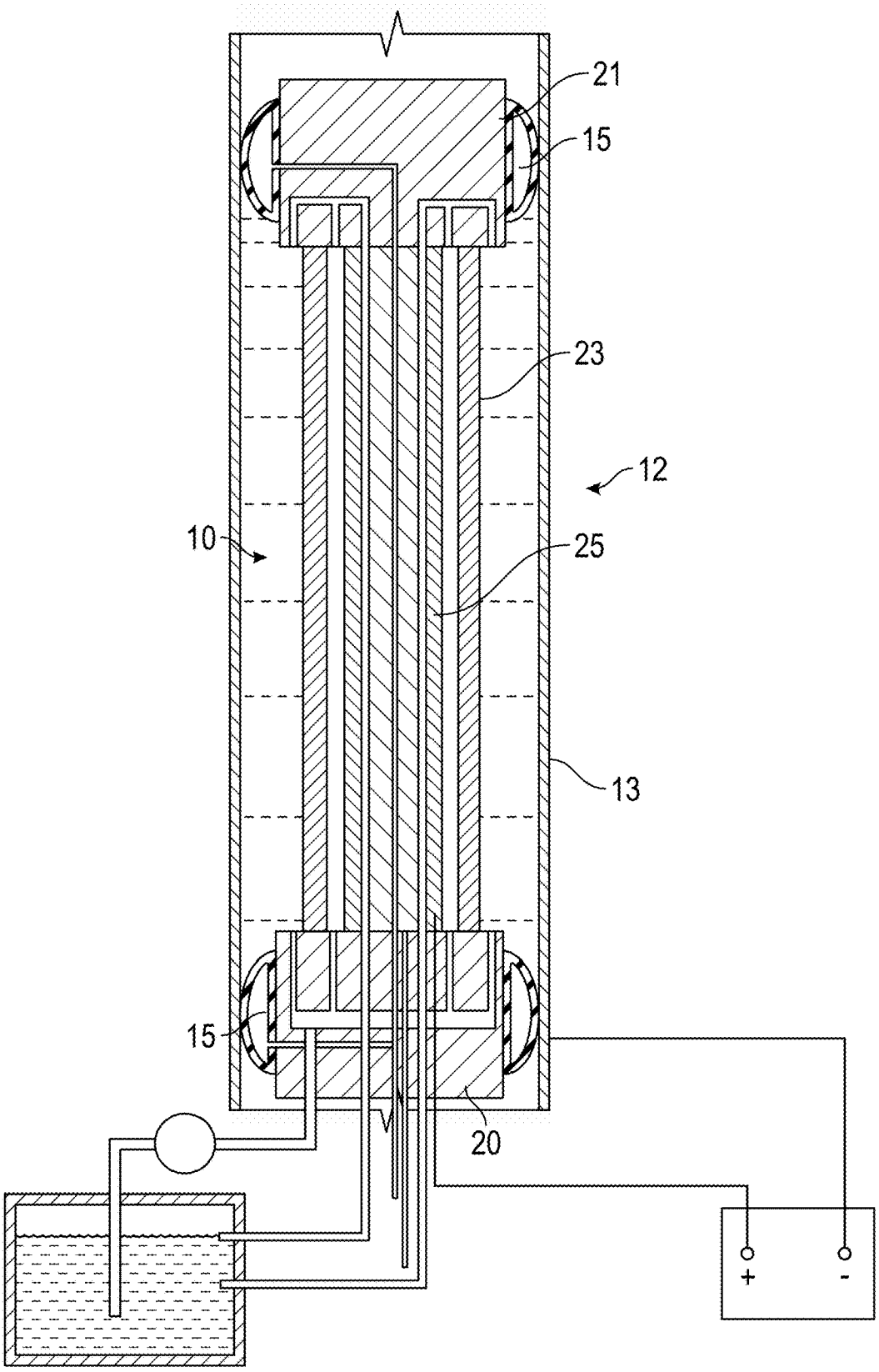
FIG. 1A (Prior Art)
FIG. 1A is a sectional view of a probe for the insertion into a straight host tube having sealing means at each end, fluid circulation means and an electrode as represented in the prior art (Palumbo et. al., U.S. Pat. No. 5,538,615 FIG. 1).

The present disclosure relates to an electrolytic cell apparatus for use with several electrolytic processes which comprises the steps of: positioning a probe containing at least one non-conductive head cap, a non-conductive end cap and at least one non-conductive counter-electrode assembly into a hollow conduit, representing the workpiece to be processed; inflating all the terminal ends of the probe to seal off a compartment defined by the internal surface of the hollow conduit and the end and head caps of the probe; thereby creating a defined "electrolytic cell volume"; and by connecting the electrolytic cell to one or more external fluid reservoirs by means of a suitable fluid circulation system. A pump is used to circulate various fluids, including electrolyte into, into and out of the defined "electrolytic cell volume". After cleaning and activating the workpiece surface with washing steps in between, electrical connections are made to the workpiece to be processed and to one or more counter-electrodes. In the case of electroplating, a suited electrolyte containing metal-ions to be plated is circulated through the electrolytic cell and a metallic material is electrodeposited onto the surface of the metallic workpiece using suitable direct current (D.C.) or pulsed current while mechanically moving the counter-electrode, representing the anode, relative to the host tube surface and the stationary head and end seals. Similarly, in the case of electropolishing, a suited ion-conductive electrolyte substantially void of metal-ions is circulated through the electrolytic cell and the surface of the metallic workpiece is electropolished by applying a suitable direct current (D.C.) or pulsed current while mechanically moving the counter-electrode, representing the cathode, relative to the host tube surface and the stationary head and end seals.

While the skilled person will appreciate that the invention has general industrial utility and application for electropolishing and/or coating a variety of metal conduits, the process will be described with particular reference to tubes. In many industrial applications tube walls must be smooth, strong and corrosion resistant while also being as thin as possible to provide efficient heat transfer across the tube wall and remain as light as possible. Under certain environmental conditions, metal tubes deteriorate, however the deterioration may not be uniform. Rather than general corrosion, erosion and/or micro-cracks or other imperfections, too, can provide sites for localized degradation, which if repaired, can significantly extend the life of the entire tube. With increased use, loss of the surface finish due to roughening can occur as well which further compromises the performance.

The in-situ electrodeposition of metallic layers has been known for some time, e.g., U.S. Pat. No. 5,516,415, however, the present invention provides a much improved and much more versatile process to electrodeposit a structural metallic layer onto the internal wall(s) of various tubular conduits. The added flexibility obtained by employing one or more counter-electrodes which can physically move versus the workpiece surface during the electrolytic operation results in the possibility to:

- process vertical and horizontal tubes;
- use independent non-conductive head and end caps, novel counter-electrodes and electrode support structures. It allows movement of the probe along and past curved sections etc., i.e., the novel probes can be deployed in locations which are not connected to the access point of the tube solely by straight tubes;
- process tubes up to 30 feet in lengths;
- form multiple patches/sleeves without deflating the seals, relocation and reactivation of the "plating cell/probe";
- to continuously plate sleeves/patches, to prepare overlapping patches etc.;
- use flexible counter-electrode assemblies for electropolishing and/or electroplating curved sections with relative ease;
- use of one or more segmented counter-electrodes which travel independently or in concert with one another and allow the deposition of sleeves/patches which are graded in one or more directions, layered as well as nano-laminated; and
- to electropolish the electrodeposited sleeves/patches as well as the host tubing.

Specifically, FIG. 1A shows an electroplating apparatus, as disclosed by Palumbo et al. in U.S. Pat. No. 5,538,615, which represents the closest prior art. The apparatus (10), also termed "probe", is inserted into a section (13) of the host tube (12) to be repaired, and a head-piece (21) is expanded to form a fluid-tight seal (15) with the host tube. Similarly an end-piece (20) is expanded to also form a fluid-tight seal (15) with the host tube. In addition, the end-piece (20) provides for gas lines to inflate the two seals, a fluid inlet and outlet which are used to (i) remove any fluid present in the sealed off "plating cell" once the seals are inflated, (ii) introduce and remove (a) one or more activation fluids to prepare the surface of the host tubing and achieve good adhesion, (b) water for rinsing in between individual process steps, (c) one or more electrolytes used, including, but not limited to a strike solution and an electroplating solution for forming the sleeve. The apparatus contains an electrode (25) which is used as anode. It is noted that the prior art apparatus of Palumbo is of fixed length, i.e., the head-piece (21) and the end-piece (20) are permanently attached to each other via a plastic housing (23), which permanently establishes the plating length of the apparatus/cell between the respective end seals (15). The electrode (25) is also permanently attached to the head-piece and the end-piece, which means that all parts of the prior art apparatus are permanently fixed in relation to each other, i.e., one apparatus provided the same fixed length, the same fixed anode length and, when used, results in a sleeve of a fixed length stretching from one end seal to the other one. To change the length of the sleeve, i.e., as may be required in multiple sleeving applications on the same host tube the entire probe (10) disclosed in U.S. Pat. No. 5,538,615 has to be deflated, extracted and replaced with another probe of a different length, as desired. Multiple sleeves of equal length can be deposited with one probe on one host tube, however, it requires deactivating the seals, moving the probe to the new location, reapplying the seal and repeating the entire activation/plating sequence. All sleeves applied would be of identical length, the operator can only vary the thickness of the sleeve.

Figure 1B:
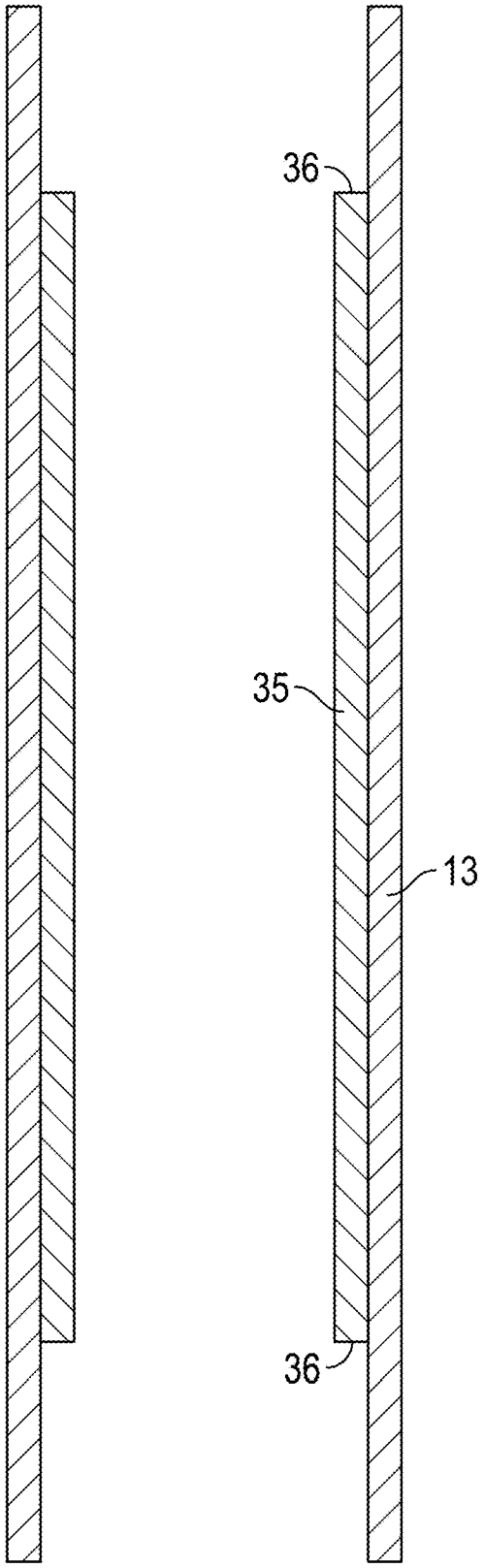
FIG. 1B (Prior Art)
FIG. 1B is a sectional view through the axial plane of the host tube of FIG. 1A comprising a deposited sleeve inside the host tube using a method according to the prior art (e.g. Palumbo et. al., U.S. Pat. No. 5,538,615).

FIG. 1B shows a simplified cross sectional view of the host tube (12) which has been "sleeved" using the prior art probe (10) described above. As all components in the probe are fixed and cannot move against one another, the resulting sleeve (35) has a length which is predetermined by the length of the probe. Also, as the anode is fixed and stationary as soon as the seals of the probe are deployed and extends over the entire length of the probe, the sleeve ends (36) are straight and sharp, a shape which is not desired from a flow perspective, as it results locally in (i) a turbulent flow and (ii) the edge of the sleeve, particularly at the flow direction is subject to increased erosion and corrosion.

Figure 2A:
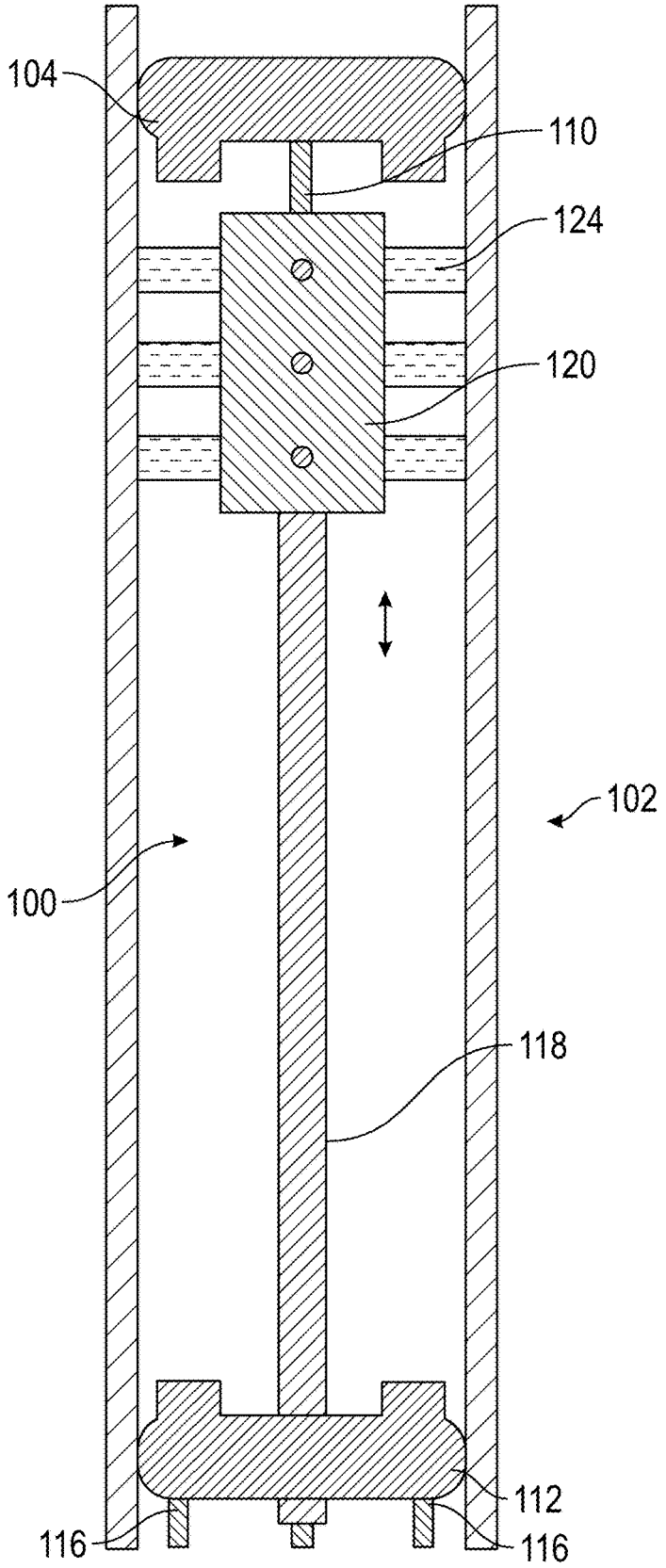
FIG. 2A is a sectional view of a probe for the insertion into a straight host tube according to one preferred embodiment of this invention.

FIG. 2A shows a plating apparatus or probe (100), according to this invention. For ease of comparison and added clarity a number of components used are not shown in FIG. 2A. They include the gas lines or alternative means for activating and deactivating the seals on each non-conductive head-piece and non-conductive end-piece, the fluid inlet and outlet in the end-piece which is used to provide and remove any fluid from the electrolytic cell to achieve a suitable fluid circulation and the fluid hose which extends from the end-piece to the head piece to allow fluid to be inserted at one end of the probe and removed from the opposite end of the probe. FIG. 2A is a cross-sectional view of the probe (100) placed in a host tube (102) to be sleeved. A non-conductive head-piece or head cap (104) is shown in its expanded form forming a fluid-tight seal with an inner surface of the host tube (102). The expandable seal of the head-piece, the connection and feed through of the means for inflating and deflating the seal, as required, are not depicted in FIG. 2A. A guide wire (110) for the non-conductive head-piece firmly holds the head-piece (104) in place and extends through and beyond the non-conductive end-piece or end cap (112) to a control unit (not shown) which is used to place and securely hold the head-piece (104) for the entire duration of the sleeving operation.

The non-conductive end-piece (112) is also shown in its expanded form forming a fluid-tight seal with the inner surface of the host tube (102). The expandable seal, the connection and feed through of the means for inflating and deflating the seal, as required, are not depicted in FIG. 2A. A guide wire (116) for the end-piece firmly holds the end-piece (112) in place for the entire duration of the sleeving operation. As noted, the non-conductive head-piece (104) and the end-piece (112) are not coupled to each other and can be manipulated and placed within the host tube independently of each other.

The end-piece (112) further has fluid-tight feed through connections, preferably in the center of the end-piece, which allow free and fluid-tight passage of the head-piece guide wire (110), and a non-conductive counter-electrode guide conduit (118). In addition, two fluid conduits such as hoses (not shown) connect the probe to an external reservoir and are used to remove the fluid present in the host tubing after the end-piece (112) and head-piece (104) are placed and sealed against the inner surface of the host tube, and for providing any additional process fluid, including, but not limited to, activation and strike solution, electrolytes used for electroplating and electropolishing, and washing solutions. Typically, one fluid conduit releases the fluid into the fluid-tight chamber formed between the end-piece, head-piece and tube inner surface near the end-piece and extracts the fluid from near the head-piece via a conduit which extends all the way through the probe to the head-piece. Depending on preferences and direction of the host tube (vertical or horizontal tube) the flow direction can be reversed, i.e., the flow intake and the flow outlet can be either near the end-piece (112) or the head-piece (104), as desired. The flow direction is typically chosen to allow for the efficient removal of any gas generated during processing from the electrolytic cell. Conveniently, a counter-electrode assembly (120) and the counter-electrode guide conduit (118) can both be hollow and of sufficient stiffness to incorporate a combination of additional features including the means for activating the head-piece seal and/or the electrolyte fluid recirculation conduit and to provide for an annular space for placing the head-piece guide wire, its seal activation means and for adding/removing fluid from near the head piece to complete the solution circulation loop.

The probe (100) contains the counter-electrode assembly 120, which during the electroplating step becomes the anode assembly and during the electropolishing step the cathode assembly. Specifically, the active counter-electrode assembly (120) can be a dimensionally stable electrode (DSE) or another non-consumable electrode. Other options include the use of metallic electrodes comprising at least one metal which can be anodically dissolved and cathodically deposited onto the workpiece in the electroplating operation, i.e., a nickel electrode in the case of Ni plating and an Al electrode in the case of Al plating. Such a soluble anode, in the case of electroplating, becomes a non-soluble cathode during the electropolishing step generating hydrogen gas. As the person familiar with the use of reverse pulses in both electroplating and electropolishing process will know, the counter-electrode can switch between being the anode and cathode during the same process. The counter-electrode assembly (120) has an outer diameter which is smaller than the inner diameter of the host tube (102) and smaller than the inner diameter of the host tube after sleeving to allow the counter-electrode assembly to be freely moved between the end-piece (112) and the head-piece (104). The counter-electrode assembly or its segments, and optionally the counter-electrode guide conduit (118), are centered within the host tube by means of guides (124) (as shown in FIG. 2A) which are non-conductive, optionally perforated guide-plates, non-conductive distinct and multiple bristles, and the like. Preferably, counter-electrodes are selected capable of serving both functions required, namely serving as anodes for the electroplating process and as cathodes for the electropolishing process.

The counter-electrode assembly (120) and counter-electrode guide wire(s) are typically sleeves to provide for an annular space which can be used to contain the head-piece guide wire (110), as well as the fluid conduit and means to inflate and deflate the head-piece seal (not shown) and allows for free movement of the head-piece ancillaries versus the counter-electrode assembly. The counter-electrode assembly (120) is connected to the counter-electrode guide conduit (118) which is used to provide the electrical connection to the counter-electrode assembly (120). The counter-electrode guide conduit has sufficient stiffness to allow for the movement of the counter-electrode assembly relative to the host tube (102) and relative to the probe end-piece and head-piece(s), it is electrically insulated to prevent participation in or interference with any of the electrochemical reactions and has an annular opening which provides for passage of the head-piece guide wire (110), as well as the head-piece inflating/deflating means (not shown) and the fluid conduit for removal/addition of fluids (not shown). In addition the counter-electrode guide conduit (118) contains fluid tight seals where the head piece guide wire (110) penetrates it while allowing the counter-electrode assembly (120) to freely move versus the head-piece. Similarly the counter-electrode guide conduit (118) contains a fluid tight seals where it penetrates the end-piece (112) while allowing the counter-electrode assembly to freely move versus the end-piece. In summary, the counter-electrode assembly (120) is configured in a way that it allows the free movement of the counter-electrode assembly relative to the host tube (102) in the electrolytic cell while maintaining fluid tight seals.

The surface of all guide wires used that is exposed to the electrolyte are electrically non-conductive, however, embedded therein can be metallic parts, e.g., steel wires to provide the necessary stiffness to the end-piece and head-piece guide wires, and/or electrical wires as provided within the counter-electrode guide conduit to provide electrical power to one or more active counter-electrode segments, incorporated electrical heaters and the like.

According to another aspect of this invention, the in-situ repair of the pipe may be carried out using a counter-electrode assembly which, on at least one active counter-electrode segment, includes a porous, compressible and non-conductive separator which can be an organic fabric or felt on its outer surface. The non-conductive fabric can be in contact with the host tube and the sleeve as it is being formed during the electrodeposition operation. As the non-conductive barrier compresses, it rubs against the host tube and the sleeve as it is being formed and automatically adjusts to the narrowing of the inner diameter of the sleeved host tube. This approach is a variation of an electroplating technique known in the art as brush or tampon plating whereby the brush-anode constantly is rubbed against the surface to be plated in a manual or mechanized mode and electrolyte solution containing ions of the metal or metal alloys to be plated is injected into the separator felt.

The person skilled in the art will know that various metallic materials used in tubes, e.g., steel, may use an "anodic activation" as one of the surface preparation processes in which case the counter-electrode assembly (120) is used as a cathode and the host tube as an anode. For striking the surface and for forming the metallic sleeve the counter-electrode assembly (120) becomes the anode and the host tube the cathode which results in the cathodic electrodeposition of a metallic material on the inner surface of the host tube. The person skilled in the art will also know that various waveforms, including, but not limited to a direct current, a pulsed current using various on and off-times, and a reversed pulse current, can be utilized in the strike and electroplating step, as well as in the electropolishing step. In the case of using a pulse reverse waveform the reverse pulse is typically applied for a relatively short period of time when compared to the forward pulse.

As highlighted, the plating apparatus of this invention comprises at least three components and their ancillaries which can be manipulated independently of each other, namely one or more head-pieces with the required ancillaries for placing and sealing the head-piece to the tube wall(s), including a fluid hose connected to an external reservoir, at least one counter-electrode assembly with the required ancillaries for placing, supplying power and manipulating the counter-electrode assembly relative to the workpiece during processing, and an end-piece with the required ancillaries for placing and sealing the end-piece to the tube wall, including another fluid hose connected to an external reservoir to provide for fluid circulation and with all the required and fluid-tight feed-through connections which connect the end-piece assembly or assemblies and the counter electrode assembly or assemblies to the external control unit.

Figure 2B:
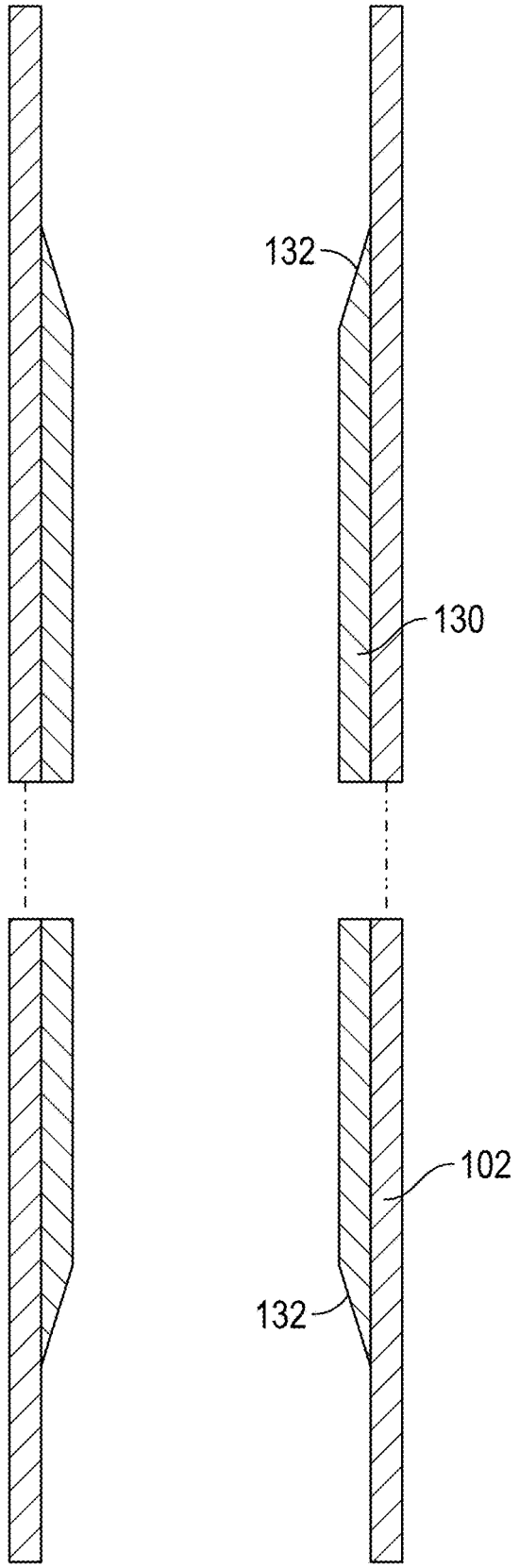
FIG. 2B is a sectional view through the axial plane of the host tube of FIG. 2A comprising a deposited sleeve inside the host tube using a method according to one preferred embodiment of this invention.

FIG. 2B shows a simplified cross sectional view of the host tube (102) which has been "sleeved" using the probe as disclosed in FIG. 2A. As the counter-electrode assembly (120) can be moved during the electroplating operation from the head-piece (104) towards the end-piece (112) or vice versa, the resulting sleeve (130) (assuming constant velocity of the probe versus the seal and constant applied current) has naturally tapered ends (132). Tapered ends are much more desired than the straight, abrupt ends obtained using the prior art probe of FIG. 1A as they provide far less impediment to the fluid flow conditions of a sleeved tube section which has a narrowed cross section compared to the host tube reducing the risk of corrosion and erosion near the interface between the sleeve and host tube.

According to the invention the method for in-situ electropolishing and/or in-situ electroforming a structural layer of metal bonded to an internal wall of a tubular conduit (i.e., host tube), comprises the steps of:

(i) Selecting a tubular conduit/metal tube which has an internal diameter of at least 4 mm;

(ii) Setting up all the external components (mixing station, various cleaning, activation, plating solution(s) and electropolishing solution(s) with their respective tanks, heaters, filters, gas separators and pumps as well as one or more power supplies, as required) in the vicinity of an access point to the tubular conduit to be processed;

(iii) Setting up fluid circulating means which provide fluid flow communication between the electrolytic cell compartment created by the probe and the host tubing and one or more external fluid reservoirs;

(iv) Opening an access point to the tubular conduit to be sleeved to allow the insertion of all probe components;

(v) Deploying all components of the probe (end-piece(s) and head-piece(s), electrode components, fluid hoses and their respective connections) using the respective guide wires and the like by inserting them at the access point in the tubular conduit and moving each of them to the desired location with all components used having an outer diameter which is smaller than the smallest tube inner diameter of the host tube before or after sleeving;

(vi) Verifying that all components of the probe have been deployed to their intended, predetermined locations, as required, and activating the sealing functions to secure the end-piece and head-piece(s) in place by forming a fluid-tight seal against the internal wall of the host tube, thereby defining the electrolytic cell compartment;

(vii) Establishing the electrical connections between the workpiece and the at least one counter-electrode assembly, as required, and the at least one the power supply, to establish the positive and negative electrode connections, as required, to provide for all electropolishing and/or electroplating steps to be performed;

(viii) Removing any residual fluid or the like trapped within the confined electrolytic cell compartment;

(ix) Initiating the surface preparation of the tubular conduit, representing the workpiece to be processed. The surface preparation can include one or more steps selected from the group consisting of mechanical cleaning; degreasing, electropolishing, degreasing, chemical activating, electrochemical activating, and washing at least the part of the surface of the internal tube wall to be processed;

(x) Optionally providing and circulating a strike solution through the electrolytic cell compartment and cathodically applying a metal strike to at least part of the tube section to be sleeved, followed by removing of the electrolyte and performing an optional washing step;

(xi) Circulating the sleeving electrolyte through the electrolytic cell compartment and electroplating a structural metallic layer onto the tube wall, said sleeving electrolyte solution containing at least one dissolved metal ion through the section and applying a D.C., pulsed or pulse-reversed current between the counter-electrode and the metal tube to electroform a metal layer of the desired thickness, while, at least for part of the plating cycle, the electrode(s)/anode(s) are moved relative to the surface of the workpiece;

(xii) Optionally washing the one or more sleeves formed within the electrolytic cell compartment, polishing and/or electropolishing the surface of at least part of the sleeves and/or the unplated host tube surface after introducing and circulating an electropolishing solution through the electrolytic cell and applying a DC, pulsed or pulse-reversed current between the counter-electrode/cathode and the metal tube/anode to smoothen the surface and achieve the desired surface roughness, while, at least for part of the electropolishing cycle, the electrode(s)/cathode(s) are moved relative to the surface of the workpiece;

(xiii) Rinsing the entire electrolytic cell compartment cavity, removing any washing fluid, collapsing the various seals and extracting all components comprising the probe from the host tube;

(xiv) Resealing the access point after optionally inspecting the one or more sleeves formed and the surface roughness of the host tube and sleeve(s); and (xv) Removing all sleeving equipment from the worksite and returning the one or more sleeved and/or electropolished tubular conduits to regular service.

Figure 3:
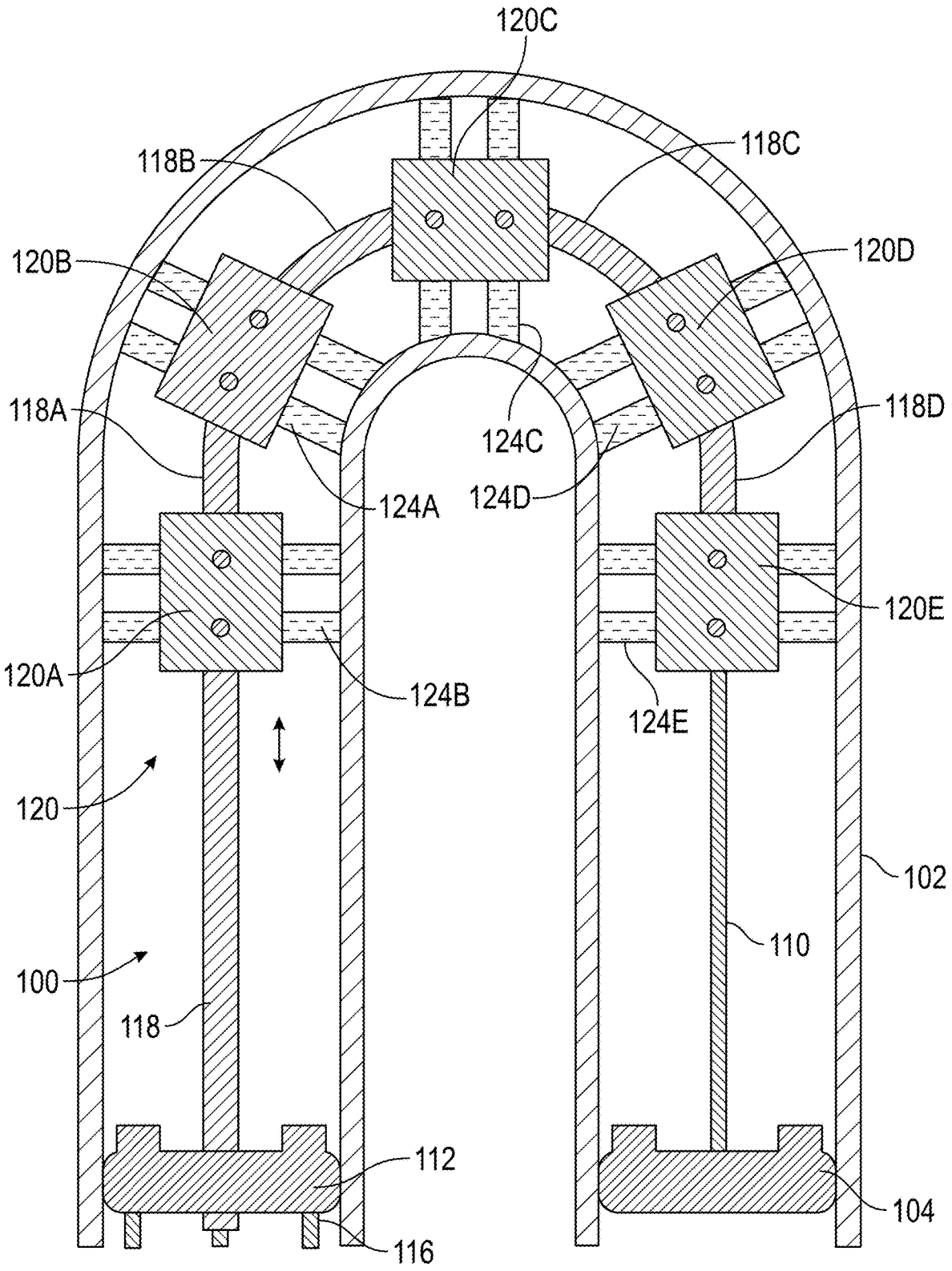
FIG. 3 is a sectional view through an axial plane of another host tube with a 180 degree bend to using a method according to another preferred embodiment of this invention.

FIG. 3 shows the in-situ electrolytic apparatus or probe (100), according to this invention employed to a host tube which is not straight but bent by 180 degrees. For ease of comparison and added clarity a number of components used are not shown in FIG. 3. The figure shows a cross-sectional view of the probe (100) in the host tube (102) to be sleeved and/or electropolished. The head-piece (104) is shown in its expanded form forming a fluid-tight seal with the host tube (102). The expandable head-piece and end-piece seals, the connection and feed-throughs of the means for inflating and deflating the respective seals, as required, are not depicted in FIG. 3. The head-piece guide wire (110) which can also comprise the fluid recirculation hose and/or the means for activating the head-piece seal that firmly holds the head-piece (104) in place extends through and beyond the end-piece (112), moved and positioned within the host tube by the guide wire (116), to the control unit (not shown) which is used to place, seal and secure the head-piece (104) in place for the entire duration of the sleeving operation.

According to another aspect of this invention in-situ sleeving and/or electropolishing of the tube may be carried out using a counter-electrode assembly (120) consisting of a string of electrode segments (120A-120E) separated by, e.g., counter-electrode guide conduits (118A-118D) and manipulated and powered by the main counter-electrode guide conduit (118) which penetrates the end-piece (112). The counter-electrode assembly or its segments and optionally the counter electrode guide conduits are centered within the host tube by means of guides (124A-124E) which are, for example, non-conductive fluid-permeable guides. The head-piece (104) is moved in place and tightly secured to the host tube (102) by the head-piece guide (110). One or more active electrode segments can contain non-conductive shields to limit the electrodeposition/electropolishing process to part of the inner diameter of the tube, e.g., in the case of sleeving to form a patch not extending across the entire circumference of the tube inner diameter or to form a sleeve of non-uniform thickness. The multiple electrode segments (120A-120E) can all be powered by one single power supply. Alternatively, each electrode segment can be powered individually and separately from adjacent electrode segments with dedicated power supplies. If two or more active electrode segments are powered individually by changing the applied current density of each electrode segment, the microstructure (in the case of electroplating) or the surface finish (in the case of electropolishing) can be varied. For instance, in the case of electroplating, higher current densities typically result in added grain-refinement and, in the case of alloy plating, the composition can be modulated as well by modulating the applied current density. In addition, the use of multiple active electrode segments is an elegant way to grade or layer the sleeve deposited on the inner surface of the host tube, particularly when the objective is for the sleeve to be a multilayer laminate. Selectively and separately powering each of the multiple active counter-electrode segments is also an elegant way to effectively, quickly and gradually electropolish the sleeve and/or host tube in stages to an increasingly finer surface finish, as the applied current and the applied waveform can be modulated as the surface roughness is being reduced during the electropolishing process and (in the direction of the electrode movement) the first electrode segment uses a waveform to smoothen the rather rough initial surface, while the following active electrode segment applies a wave form to further smoothen the already treated surface and so on.

Figure 4:
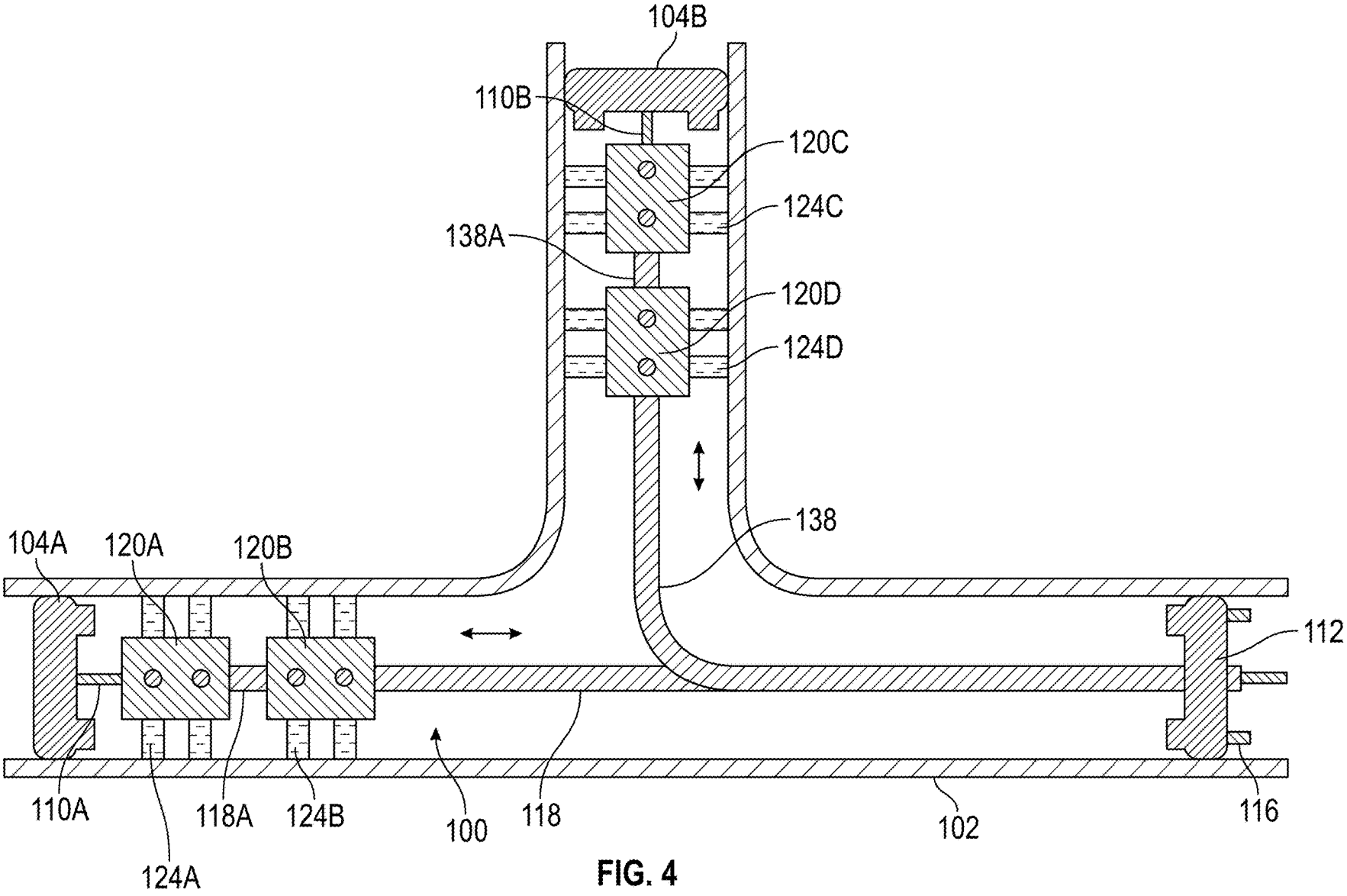
FIG. 4 is a sectional view through an axial plane of another host tube, for example a tee, using a method according to another preferred embodiment of this invention.

FIG. 4 shows a cross sectional view of the in-situ electroplating and/or the in-situ electropolishing apparatus or probe (100), according to this invention employed to a T-joint provided as part of the host tube (102). For ease of comparison and added clarity a number of components used are not shown in FIG. 4. The figure illustrates the use of multiple counter-electrode assemblies, specifically two independent ones, with two distinct counter electrode guide conduits (118, 118A and 138, 138A) which are independent from each other so two or more counter-electrode assemblies or strings of electrode segments, namely first string of counter-electrode segments (120A-120B) and second string of counter-electrode segments (120C-120D) can be operated. Again, the counter-electrode assemblies or its segments and optionally the counter electrode guide conduits are centered within the host tube (102) by means of guides (124A-124D) which are, for example, non-conductive fluid-permeable guides. The two independent strings of electrodes can be manipulated and powered independently of one another and the counter-electrode or its segments and the counter electrode guide conduits are centered within the host tube by means of guides.

In operation, a control unit is used to handle one or more probes at a time. Only one opening is required in the host tube to provide the access point for the probe assembly. The probe assembly is inserted into the host tube and moved to the intended, predetermined location of the sleeving and/or electropolishing operation. Once in the vicinity of the target area the end-piece (112) and the head-piece(s) (104A and 104B) are appropriately placed with in the host tube via the respective guide wires 110A, 110B and 116 and their respective seals are employed, to seal off a length of the tubing ($l_{Compartment}$) extending between the respective locations of the end-piece and head-piece and referred to as the electrolytic "cell" or "cell compartment". The fluid supply conduits are used to remove any fluid trapped within the electrolytic cell formed between the end-piece, the head-piece(s) and the inner surface of the host tube. Activation of the tube surface is achieved by providing and, after a predetermined period of time, removing one or more activation fluids with washing steps using, e.g., deionized (DI) water in between. If the activation includes an anodic activation step, the electrode assembly is maneuvered by the guide conduit to the desired location and current is passed between the electrode and the host tube. The electrode can be moved during the anodic activation to fully activate whatever portion, portions and up to the entire length ($l_{Compartment}$) of the cell. Electrodeposition of one or more metal compositions takes place by providing for the appropriate electrolyte solution using the fluid conduits and, once the desired operating temperature is reached the counter-electrode assembly is placed at the desired starting point within the length of the compartment. Electroplating is started by applying a current between the host tube (acting as the cathode) and the counter electrode(s) and the plating schedule is executed. The plating schedule uses predetermined conditions, such as the applied current, the residence time in the starting position, the speed and time at which the counter-electrode is moved relative to the host tube, and the endpoint of the mechanical movement of the anode at which the current is turned off and plating stops. A simple plating process can be used, however, the design of the apparatus provides for a number of variations including, but not limited to, movement of the counter-electrode back and forth over the area to be sleeved, varying one of the relative speed of the electrode and the current density to affect changes in the thickness of the deposit, applying a current/speed profile to result in graded and or layered sleeves etc., as desired. Furthermore multiple distinct sleeves can be applied along the entire length ($l_{Compartment}$) of the cell without the need to deflate the seals and move the entire probe. Similarly, the probe can also be used to electropolish the surface of the host tube and/or the patches/sleeves to achieve the desired surface roughness by a simple or multi-step process taking advantage of all parameters which can be controlled and varied.

The fluid conduits are connected to a temperature controlled reservoir in order to achieve and maintain the desired operating temperature, filter out impurities, provide for gas separation, adjust the fluid composition such as the pH, metal-ion concentration(s), additive concentration(s) etc., as desired. As the inner diameter of the host tube and the length of the cell compartment increases and results in an unacceptable temperature drop along the length of the probe, one or more electrical heaters can be incorporated within the apparatus, e.g., attached to or incorporated in the counter-electrode assembly and provided with power through wires placed within the counter-electrode conduit.

One or more power supplies are used during the activation, strike and plating operation as well as the electropolishing operation and electrical connections are provided to (i) the workpiece/host tube to be sleeved and/or electropolished and (ii) the counter-electrode assembly of the probe. The electrolytic cell is completed by providing a suitable, ion conductive electrolyte to the cell compartment created which is hermetically sealed off from the remaining host tube. Once electric current is applied between the working-electrode and counter-electrode(s) while the plating solution is circulated through the electrolytic cell the sleeve formation commences and continues until the desired sleeve thickness and properties are reached. Similarly, once electric current is applied to the working-electrode and counter-electrode(s) while the electropolishing solution is circulated through the electrolytic cell the surface roughness is reduced until the desired surface finish is reached.

The present invention provides for an apparatus and a method to in-situ electropolish and/or in-situ electroplate one or more patches or sleeves over the degraded portion(s) of the hollow conduit by various electrolytic processes which do not require the removal of the workpiece from the installation and without the need to submerse the entire workpiece to be processed/repaired into a electrolytic tank. Thus, only a portion of the workpiece such as a pipe/tube is being electropolished and/or covered by the reinforcing metallic patch/sleeve. In other words the reinforcing metallic layer is selectively formed on the surface of the workpiece wherein the patch covers the degraded portion of the workpiece without covering at least a portion of a non-degraded portion of the workpiece. Thus one or more patches/sleeves are substantially confined to the degraded portion(s) of the workpiece although there may be some overlap onto non-degraded portions of the workpiece, but it is not essential to cover the entire workpiece with the patch/layer. By a "non-degraded portion of the workpiece" it is meant that this portion of the workpiece has not been degraded to the point of needing repair which means that the non-degraded portion of the workpiece can function as intended.

According to a preferred embodiment of the invention, nanocrystalline deposits of the metals, metal alloys and metal matrix composites are obtained when process parameters such as current density, duty cycle, workpiece temperature, plating solution composition, solution temperature and solution circulation rates are varied over a wide range of conditions.

The person skilled in the art of electrodeposition will know what coatings are suited for the repair of a tubular object taking into consideration the composition of the host tubular object and the particular properties of the electroformed sleeve to be required, including, but not limited to, nanocrystalline coatings described by Erb et al. in U.S. Pat. No. 5,352,266 (1994) and in U.S. Pat. No. 5,433,797 (1995), and Palumbo et al. in U.S. Pat. No. 5,527,445 (1996), U.S. Pat. No. 5,516,415 (1996) and in U.S. Pat. No. 5,538,615 (1996), Palumbo et al. in U.S. Pat. Appl. No. 2005/0205425, as well as Tomantschger et al. in U.S. Pat. No. 9,005,420 (2015) in case graded, layered or nano-laminated sleeves are desired. The specifications of all disclosures above are incorporated herein by reference. Furthermore, the person skilled in the art will know how to electrodeposit selected crystalline (coarse grained or nanocrystalline), amorphous and/or mixed crystalline and amorphous metallic materials by selecting suitable plating bath formulations and plating conditions. Optionally, solid particles can be suspended in the electrolyte and are included in the deposit to form metal matrix composites. Similarly, in the case of depositing light metallic materials, e.g., Al and/or its alloys, which cannot be electrodeposited from aqueous solutions, suitable non-aqueous electrolytes such as ionic liquids are used.

The person skilled in the art of material science will appreciate that minimizing the thickness of repair coatings, particularly when applied to the inner diameter of heat-exchanger tubes, can be achieved by increasing the material strength through grain size reduction. Since some ductility is generally required in the electrodeposited metal sleeves of this invention, micro-crystalline or nanocrystalline coatings are generally preferred over amorphous deposits. Depending on the specific circumstance, however, graded, layered or nano-laminated coatings may provide suitable mechanical properties that allow a further reduction of the coating thickness. Incorporating a sufficient volume fraction of particulates can also be used to further enhance the material properties of the sleeves.

The person skilled in the art will know that the goal is to achieve the desired mechanical and chemical properties of the sleeve with the minimum coating thickness to limit any adverse effect on flow conditions in a sleeved tube compared to the original tube, heat capacity and heat exchange properties, etc. As the present invention provides relatively thick, structural and/or functional coatings, typical layer/sleeve thicknesses in the deposition direction are preferably at least 0.05 mm, such as at least than 0.1 mm, more preferably at least 0.25 mm, and up to 5 mm.

The person skilled in the art will know that various D.C. and pulse electrodeposition plating schedules can be used. They include periodic pulse reversal, a bipolar waveform alternating between cathodic pulses and anodic pulses. Anodic pulses can be introduced into the waveform before, after or in between the on-pulse(s) and/or before, after or during the off time(s). The anodic pulse current density is generally equal to or greater than the cathodic current density. The anodic charge ($Q_{anodic}$) of the "reverse pulse" per cycle is always smaller than the cathodic charge ($Q_{cathodic}$). The use of periodic pulse reversals has been found to be particularly effective in raising the temperature at which grain growth occurs and for leveling of the deposit.

The person skilled in the art will know that the flow conditions within the electrolytic cell, particularly on or near the surface of the workpiece, can have a great influence on the properties of the electrodeposit (composition, morphology, surface roughness, etc.). As the aspect ratio of the electrolytic cell formed by the probes described herein can be large (ratio of tube length to the tube inner diameter), flow conditions can be non-uniform and maintaining them challenging. It is therefore within the scope of this invention to modify the fluid inlet(s), fluid outlet(s) and return line(s), as required. For instance, it may be advantageous that a single fluid inlet in the end-piece be replaced by a set of multiple inlets, possibly including adjustable (in terms of flow and direction) jets. Similarly, fluid returns in the head-piece(s) can range from a single opening to multiple to an array of multiple openings connected to the return fluid hose. The fluid hose(s), too, can be modified to contain openings etc., as desired, to optimize the flow conditions within the electrolytic cells. Lastly, the design of the various perforated guides, whose main function it is to keep the counter-electrode segments and the counter-electrode guide conduit(s) reasonably centered within the host tubing at all times, can take fluid flow dynamics into consideration.

In some applications, e.g., the in-situ repair of conventional seamless cupronickel tubing commonly found on marine vessels, the host tubing can be made of Cu—Ni (90% Cu and 10% Ni or 70% Cu and 30% Ni) alloys and preferably the sleeve, too, is a Ni—Cu alloy. The sleeve alloy can be chosen to minimize galvanic reactions between the sleeve and host material, e.g., nanocrystalline Ni-rich alloys containing 10-35% Cu have also been successfully deposited.

Figure 5:
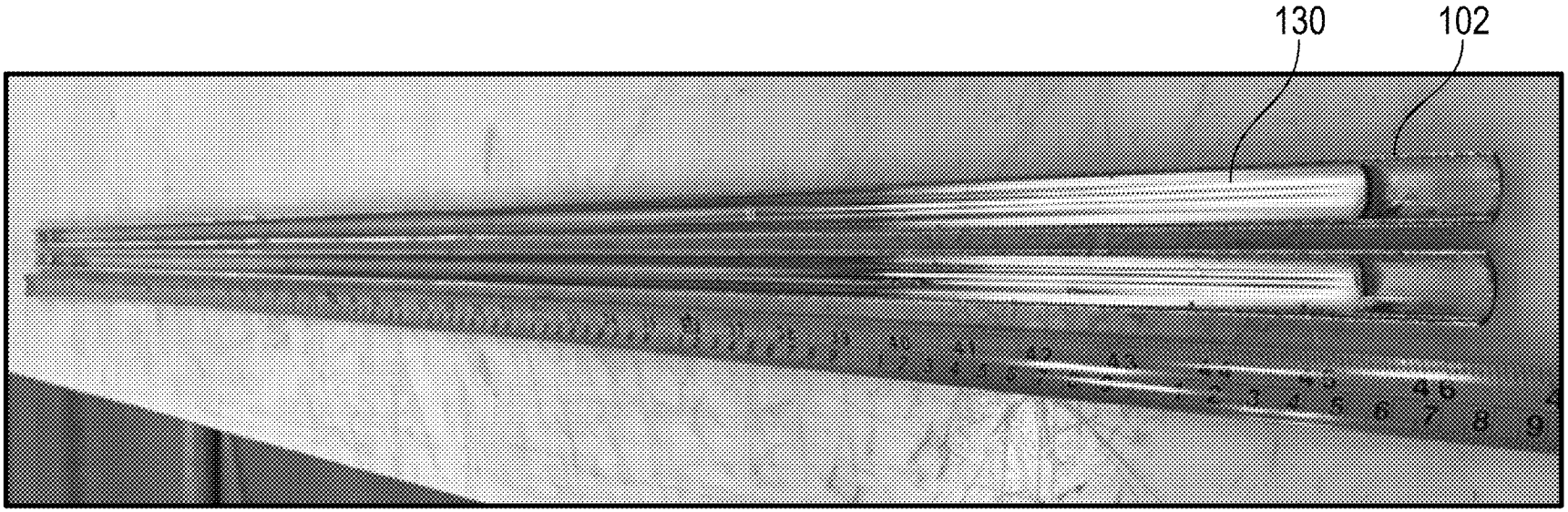
FIG. 5 is a sectional view through an axial plane of a sleeved Cu—Ni host tube which has been processed with a probe as described in FIG. 2A.

FIG. 5 shows a picture of a straight tube (90Cu-10Ni, ID ~0.53", wall thickness: ~0.05") which was sleeved according to this invention and thereafter sectioned along its length using a probe as described in FIG. 2A. Both halves of the sectioned tube are depicted in the picture showing the ~45" long metallic Ni—Cu sleeve containing about ~32% Cu (the balance being Ni), having a hardness of 450 VHN (corresponding to an average grain size of about 20-50 nm) having a surface roughness $R_a$=1.5 μm and having an average thickness of about 100 μm.

Figure 6A:
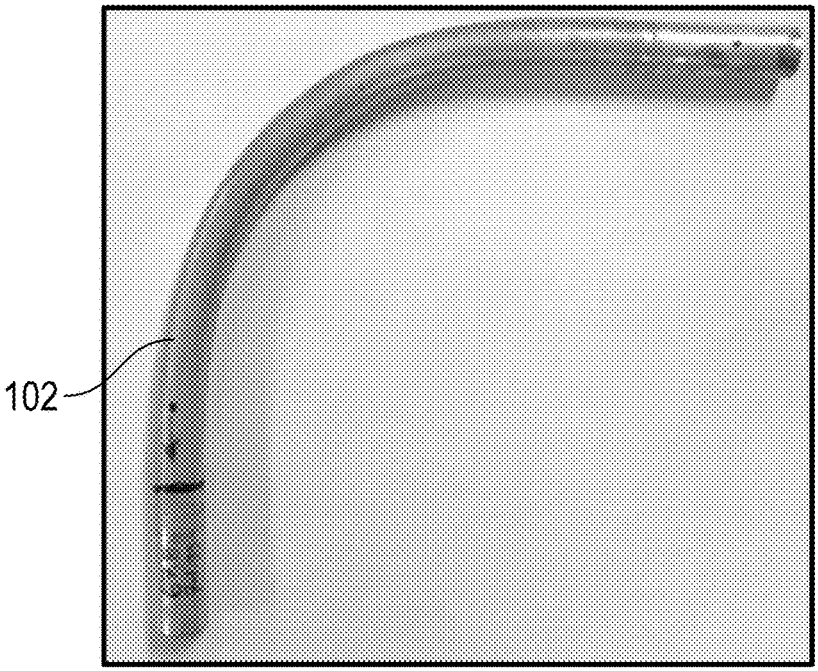
FIG. 6A shows a Cu host tube having a 90 degree turn.
Figure 6B:
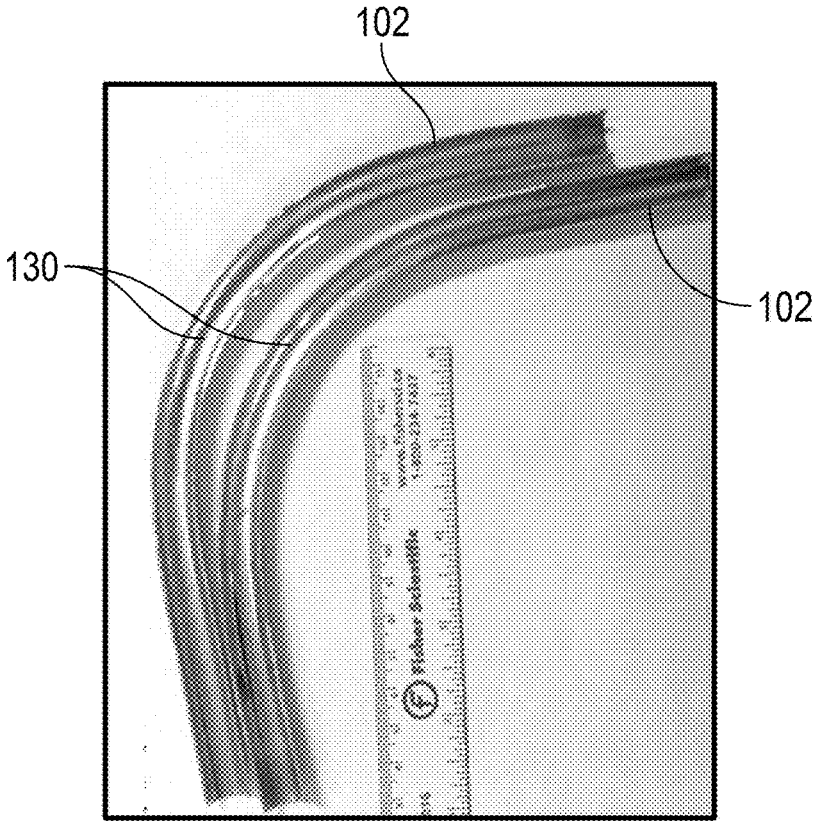
FIG. 6B shows a sectional view through an axial plane of the host tube depicted in FIG. 6A after it has been sleeved with a probe as described.

FIGS. 6A and 6B show a picture of a section of Cu tube (ID ~⅜", wall thickness: ~0.05") containing a 90 degree bend, which was sleeved according to this invention before (FIG. 6A) and after it was sectioned along its length (FIG. 6B) using a probe similar to the one described in in FIG. 3. Both halves of the sectioned tube are depicted in the picture showing the ~12" long nanocrystalline Ni sleeve (hardness of 500 VHN, corresponding to an average grain size of about 15-30 nm) having a surface roughness $R_a$=1.5 μm and having an average thickness of about 100 μm.

According to another preferred embodiment of the invention, the workpiece can be electropolished in the same apparatus before or after the metallic sleeves/patches have been deposited to reduce the surface roughness and improve the fatigue performance.

The person skilled in the art of electropolishing will know how to electromachine or electropolish metallic surfaces to make them smoother as described, e.g., by Farin et al. in U.S. Pat. No. 2,764,540 (1956) and Taylor et al. in U.S. Pat. No. 9,987,699. (2018) or in Landolt et al., Electrochemcia Acta, Vol. 32, No. 1, pp 1-11 (1987). Ni—Cu alloys (tubes and sleeves) can conveniently be electropolished in mixed acids, e.g. inorganic acids such as $H_2SO_4$, $HClO_4H_3PO_4$ and/or organic acid solutions, by applying an anodic potential onto the tube which may or may not contain electroplated patches/sleeves. As very limited amounts of metal are oxidized from the workpiece surface and released as metal ions into the electrolyte solution, the predominant reaction occurring in these aqueous electrolytes is the decomposition of water, i.e., the anodically generation of oxygen gas and the cathodic generation of hydrogen gas. Furthermore, compared to electrodeposition which typically employs a current density in the range of between 5 and 150 mA/cm$^2$, the applied current density for electropolishing is much higher, e.g., as high as 1 A/cm$^2$ or even as high as 10 A/cm$^2$. Electropolishing typically also requires much higher flow rates than electrodeposition (1-100 m/sec) and selection of the appropriate electrode gap (0.1 mm to 10 cm). In confined spaces such as tubes handling the massive amount of gas generated during the electropolishing process can pose problems as the length of the tube (and its diameter) increases as is evident in the electropolishing devices described in the prior art. While neither described nor contemplated in the prior art, if a prior art electrosleeving probe placed in a vertical tube would nevertheless be used for electropolishing the rising gas will tend to accumulate in the head space at least partly blocking the electrochemical reaction near the top as the counter-electrode extends over the full length of the probe from the end-piece to the head-piece resulting in an uneven surface finish. In addition, if the counter-electrode used is a dimensionally stable electrode made of or coated with a noble metal such as Pt, Pd, Rh or Au, the Brown's gas, which is a stoichiometric mixture of two parts hydrogen and one part oxygen derived from water electrolysis, accumulating in the head space can be ignited by the noble metal.

Furthermore, as the ionic conductivity along the length in a vertical tube drops from the bottom to the top due to the increasing volume fraction of rising gas along the height, the length of the tube that can be effectively and uniformly electropolished is severely limited. The formation of an electrolytic cell, as described in this specification, where the length of the cell is larger than the length of the effective counter-electrode assembly, and the "active" length of the counter-electrode can further be controlled and reduced by the use of active electrode segments, these limitations are elegantly overcome. As the length of the counter-electrode limits the size of the effective area treated, the total applied current and therefore the total amount of gas generated is reduced while still maintaining the high current density required for electropolishing. The movable central electrode assembly and the possible use of active electrode segments allow electropolishing of the tube before and/or after the electrosleeving operation, as the length (and applied current density) of the electrode or active electrode segment used limits the applied current and the resulting gas generation. Even in the case where the electrolyte circulation flow is insufficient to carry out all the gas generated during the electropolishing operation, gases will collect in the head space and as the counter-electrode is moved away from the head-piece, the impact of the gas bubbles on the local current density is reduced. Unlike electropolishing, electroplating does not experience the same issues with gas generation as the applied current densities used are typically much lower and the cathodic reactions are predominately the reduction of metal ions and the resulting deposition of a metal layer onto the host tube. In the case of using soluble anodes, the anodic reactions are predominately the oxidation of metal to form metal ions in solution and the generation of gases can be substantially reduced or even avoided.

The foregoing description of the invention has been presented describing certain operable and preferred embodiments. It is not intended that the invention should be so limited since variations and modifications thereof will be obvious to those skilled in the art, all of which are within the spirit and scope of the invention.

What is claimed is:

1. An electrolytic process method for selectively electropolishing at least a portion of an internal surface of a tubular workpiece in-situ and/or selectively electrodepositing at least one metallic layer or patch on at least a portion of the internal surface of the tubular workpiece in-situ by forming an electrolytic cell comprising:

(i) inserting a probe comprising a non-conductive end-piece, at least one non-conductive head-piece and at least one counter-electrode assembly and their ancillary components into the tubular workpiece;

(ii) moving and positioning the at least one non-conductive head-piece by at least one first independent guide wire to a predetermined first location within the tubular workpiece; followed by:

(iii) moving and placing the at least one counter-electrode assembly by at least one electrode guide conduit to a predetermined second location within the tubular workpiece; followed by:

(iv) moving and positioning the non-conductive end-piece by a second independent guide wire to a predetermined third location within the tubular workpiece;

(v) establishing fluid-tight seals between the tubular workpiece and the end-piece and the at least one head-piece thereby securing the end-piece and the at least one head-piece at their respective predetermined locations, thereby forming a fluid-tight electrolytic cell defined by an internal volume created and confined by the tubular workpiece, the at least one head-piece and the end-piece, wherein the second location of the at least one counter-electrode assembly is also within the electrolytic cell;

(vi) wherein the end-piece further provides a fluid-tight feed through of the at least one first guide wire and the at least one electrode guide conduit;

(vii) providing electrical connections to both the workpiece and, via the at least one counter-electrode conduit to the at least one counter-electrode assembly;

(viii) passing electrical current provided by an associated power supply between the workpiece and the at least one counter-electrode assembly while circulating electrolyte throughout the electrolytic cell while, at least at times, moving the at least one counter-electrode assembly relative to the workpiece during the electrolytic process to initiate the in-situ selective electropolishing and/or selective electrodepositing process; and (ix) collecting the electrolyte solution exiting the electrolytic cell and prior to recirculating the electrolyte solution back to the electrolytic cell in an associated external reservoir performing at least one monitoring/adjustment task selected from the group consisting of, electrolyte composition, pH, temperature, solid impurity filtering, and gas separation.

2. The method of claim 1, wherein at least a portion of the internal surface of a tubular workpiece is in-situ selectively electropolished and a metallic layer is in-situ selectively electrodeposited during the electrolytic process.

3. The method of claim 1, wherein the electric current applied between the workpiece and the at least one counter-electrode assembly is modulated during the electrolytic process.

4. The method of claim 1, wherein the electric current applied between said workpiece and the at least one counter-electrode assembly in-situ electrodeposits at least one metallic material along at least part of the length of said workpiece.

5. The method of claim 4, wherein said metallic material comprises at least one element selected from the group consisting of Al, Co, Cu, Fe and Ni.

6. The method of claim 4, wherein the applied electric current and the relative counter-electrode motion speed are used to control the metallic sleeve dimensions and composition.

7. The method of claim 6, wherein the applied current and the relative electrode motion speed is used to form tapered sleeve cross-sections at the beginning and at the end of said in-situ electrodeposited sleeve.

8. The method of claim 1, wherein said electrolytic process is electrodeposition and the electrolyte contains one or more metal ions which are cathodically deposited onto the workpiece.

9. The method of claim 1, wherein said electrolytic process is electropolishing and the electrolyte contains one or more acids selected from the group consisting of inorganic acids and organic acids.

10. The method of claim 9, wherein at least a portion of the internal surface of the tubular workpiece and/or the electrodeposited sleeve are in-situ selectively electropolished to a surface roughness $R_a$<1 μm.

11. The method of claim 1, wherein said workpiece is selected from the group consisting of a straight tube, a bent tube and a tee.

12. An apparatus for in-situ selectively electropolishing and/or selectively electrodepositing a metallic coating on a portion of an internal surface of a tubular workpiece comprising:

(i) an enclosed electrolytic cell defined by part of the internal surface of the tubular workpiece which represents a working-electrode, and at least one non-conductive head-piece and a non-conductive end-piece, each of the at least one head-piece and the end-piece forms a fluid-tight seal against the internal surface of the tubular workpiece;

(ii) independent guide wires for positioning the at least one head-piece and the end-piece at respective first and second predetermined locations within the tubular workpiece;

(iii) the end-piece further includes fluid-tight feed throughs for the at least one guide wire of the at least one head-piece and at least one electrically non-conductive counter-electrode guide conduit; and (iv) at least one counter-electrode assembly positioned within electrolytic cell, the at least one counter-electrode assembly having at least one active electrode segment centered within an inner diameter of the workpiece by at least one spacer and connected to the at least one counter-electrode guide conduit, the at least one counter-electrode assembly configured to supply electrical current from an associated power supply to the workpiece and the at least one active electrode segment, wherein the at least one counter-electrode assembly is configured to move relative to the workpiece, the end-piece and the at least one head-piece during operation of the apparatus.

13. The apparatus of claim 12, wherein the at least one active counter-electrode segment comprises a non-conductive shield.

14. The apparatus of claim 12, wherein the at least one counter-electrode assembly includes at least two active counter-electrode segments comprising electrode guides to maintain the active counter-electrode segments centered against the internal surface of the tubular workpiece, the at least two active counter-electrode segments are electrically connected by counter-electrode guide conduits independently of each other to provide dedicated electrical current to each of the active counter-electrode segments and the workpiece.

15. The apparatus of claim 14, wherein the active counter-electrode segments comprise active electrode materials which are different from one another.

16. The apparatus of claim 14, wherein at least one active counter-electrode segment is a dimensional stable electrode.

17. The apparatus of claim 12 containing at least one part for improving the fluid circulation within the electrolytic cell selected from the group consisting of jets, adjustable jets and perforated guides.

18. The apparatus of claim 12 wherein the workpiece is in the form of a bent tube, and the at least one counter-electrode assembly includes at least two active counter-electrode segments positioned along a curved section of the bent tube, each of the counter-electrode segments centered within the curved section by at least one guide.

19. The apparatus of claim 12 wherein the workpiece is in the form of a tee having a first section and a second section oriented perpendicular to the first section, and the at least one counter-electrode assembly includes at least one active first counter-electrode segment positioned along the first section and at least one active second counter-electrode segment positioned along the second section.

20. The apparatus of claim 19, wherein the active first and second counter-electrode segments are electrically connected by respective active first and second counter-electrode guide conduits independently of each other to provide dedicated electrical current to each of the active first and second counter-electrode segments and the workpiece.

* * * * *